US010844696B2

(12) United States Patent
Eitschberger et al.

(10) Patent No.: US 10,844,696 B2
(45) Date of Patent: Nov. 24, 2020

(54) POSITIONING DEVICE FOR SHAPED CHARGES IN A PERFORATING GUN MODULE

(71) Applicant: DynaEnergetics GmbH & Co. KG, Troisdorf (DE)

(72) Inventors: Christian Eitschberger, Munich (DE); Arash Shahinpour, Troisdorf (DE); Gernot Uwe Burmeister, Austin, TX (US); Thilo Scharf, Letterkenny (IE)

(73) Assignee: DynaEnergetics Europe GmbH, Troisdorf (DE)

( * ) Notice: Subject to any disclaimer, the term of this patent is extended or adjusted under 35 U.S.C. 154(b) by 0 days.

(21) Appl. No.: 16/455,816

(22) Filed: Jun. 28, 2019

(65) Prior Publication Data

US 2020/0024934 A1 Jan. 23, 2020

Related U.S. Application Data

(63) Continuation of application No. 16/272,326, filed on Feb. 11, 2019, now Pat. No. 10,458,213.

(60) Provisional application No. 62/699,484, filed on Jul. 17, 2018, provisional application No. 62/780,427, filed on Dec. 17, 2018.

(51) Int. Cl.

| | |
|---|---|
| ***E21B 43/1185*** | (2006.01) |
| ***E21B 33/068*** | (2006.01) |
| ***E21B 47/09*** | (2012.01) |

(52) U.S. Cl.

CPC ..... *E21B 43/1185* (2013.01); *E21B 33/068* (2013.01); *E21B 47/09* (2013.01)

(58) Field of Classification Search

CPC ..... E21B 43/11; E21B 43/116; E21B 43/117

See application file for complete search history.

(56) References Cited

U.S. PATENT DOCUMENTS

| | | | |
|---|---|---|---|
| 438,305 | A | 10/1890 | Edison |
| 2,216,359 | A | 10/1940 | Spencer |
| 2,228,873 | A | 1/1941 | Hardt et al. |
| 2,264,450 | A | 12/1941 | Mounce |

(Continued)

FOREIGN PATENT DOCUMENTS

| | | | |
|---|---|---|---|
| CA | 2003166 | A1 | 5/1991 |
| CA | 2821506 | A1 | 1/2015 |

(Continued)

OTHER PUBLICATIONS

International Searching Authority, International Search Report and Written Opinion of International App. No. PCT/IB2019/000569, which is in the same family as U.S. Appl. No. 16/455,816, dated Oct. 9, 2019, 12 pages.

(Continued)

*Primary Examiner* — Jennifer H Gay

(74) *Attorney, Agent, or Firm* — Moyles IP, LLC

(57) ABSTRACT

A positioning device includes a shaped charge holder. A plurality of shaped charge receptacles formed in the shaped charge holder are configured to arrange a plurality of shaped charges in a desired orientation. The shaped charges are detonated by a detonator in response to an initiation signal. The positioning device may be secured in a perforating gun module, with vertical and horizontal movement of the positioning being inhibited in the perforating gun module.

21 Claims, 17 Drawing Sheets

(56) References Cited

U.S. PATENT DOCUMENTS 2,326,406 A 8/1943 Lloyd
2,358,466 A 9/1944 Miller
2,418,486 A * 4/1947 Smylie ..... E21B 43/116 175/4.58
2,439,394 A 4/1948 Lanzalotti et al.
2,543,814 A 3/1951 Thompson et al.
2,598,651 A 5/1952 Spencer
2,637,402 A 5/1953 Baker et al.
2,640,547 A 6/1953 Baker et al.
2,649,046 A 8/1953 Oliver
2,655,993 A 10/1953 Lloyd
2,692,023 A 10/1954 Conrad
2,708,408 A 5/1955 Sweetman
2,742,856 A 4/1956 Fieser et al.
2,761,384 A 9/1956 Sweetman
2,766,690 A 10/1956 Lebourg
2,873,675 A 2/1959 Lebourg
2,889,775 A 6/1959 Owen
2,906,339 A 9/1959 Griffin
2,996,591 A 8/1961 Thomas
3,013,491 A 12/1961 Poulter
3,040,659 A 6/1962 Mcculleugh
3,080,005 A 3/1963 Porter
RE25,407 E 6/1963 Lebourg
3,128,702 A 4/1964 Christopher
3,158,680 A 11/1964 Lovitt et al.
3,170,400 A 2/1965 Nelson
RE25,846 E 8/1965 Campbell
3,209,692 A 10/1965 George
3,211,093 A 10/1965 Mccullough et al.
3,246,707 A 4/1966 Bell
3,264,989 A 8/1966 Rucker
3,320,884 A 5/1967 Kowalick et al.
3,327,792 A 6/1967 Boop
3,357,355 A 12/1967 Roush
3,374,735 A 3/1968 Moore
3,414,071 A 12/1968 Alberts
3,415,321 A 12/1968 Venghiattis
3,504,723 A 4/1970 Cushman et al.
3,565,188 A 2/1971 Hakala
3,621,916 A 11/1971 Smith, Jr.
3,650,212 A 3/1972 Bauer
3,659,658 A 5/1972 Brieger
3,859,921 A 1/1975 Stephenson
3,892,455 A 7/1975 Sotolongo
4,007,790 A 2/1977 Henning
4,007,796 A 2/1977 Boop
4,034,673 A 7/1977 Schneider, Jr.
4,058,061 A 11/1977 Mansur, Jr. et al.
4,071,096 A 1/1978 Dines
4,080,898 A 3/1978 Gieske
4,084,147 A 4/1978 Mlyniec et al.
4,085,397 A 4/1978 Yagher
4,100,978 A 7/1978 Boop
4,107,453 A 8/1978 Erixon
4,140,188 A * 2/1979 Vann ..... E21B 43/117 166/63
4,182,216 A 1/1980 DeCaro
4,191,265 A 3/1980 Bosse-Platiere
4,208,966 A 6/1980 Hart
4,216,721 A 8/1980 Marziano et al.
4,261,263 A 4/1981 Coultas et al.
4,266,613 A 5/1981 Boop
4,284,235 A 8/1981 Diermayer et al.
4,290,486 A 9/1981 Regalbuto
4,306,628 A 12/1981 Adams, Jr. et al.
4,312,273 A 1/1982 Camp
4,319,526 A 3/1982 DerMott
4,345,646 A 8/1982 Terrell
4,346,954 A 8/1982 Appling
4,387,773 A 6/1983 McPhee
4,393,946 A 7/1983 Pottier et al.
4,411,491 A 10/1983 Larkin et al.
4,430,939 A 2/1984 Harrold
4,491,185 A 1/1985 McClure
4,496,008 A 1/1985 Pottier et al.
4,523,649 A 6/1985 Stout
4,523,650 A 6/1985 Sehnert et al.
4,534,423 A 8/1985 Regalbuto
4,541,486 A 9/1985 Wetzel et al.
4,574,892 A 3/1986 Grigar et al.
4,576,233 A 3/1986 George
4,583,602 A 4/1986 Ayers
4,598,775 A * 7/1986 Vann ..... E21B 43/117 102/310
4,609,057 A 9/1986 Walker et al.
4,619,320 A 10/1986 Adnyana et al.
4,621,396 A * 11/1986 Walker ..... E21B 43/117 102/321.1
4,640,354 A 2/1987 Boisson
4,643,097 A 2/1987 Chawla et al.
4,650,009 A 3/1987 McClure et al.
4,657,089 A 4/1987 Stout
4,660,910 A 4/1987 Sharp et al.
4,670,729 A 6/1987 Oh
4,744,424 A 5/1988 Lendermon et al.
4,747,201 A 5/1988 Donovan et al.
4,753,170 A * 6/1988 Regalbuto ..... C06C 5/04 102/200
4,766,813 A 8/1988 Winter et al.
4,776,393 A 10/1988 Forehand et al.
4,790,383 A 12/1988 Savage et al.
4,796,708 A 1/1989 Lembcke
4,800,815 A * 1/1989 Appledorn ..... E21B 43/117 102/312
4,850,438 A 7/1989 Regalbuto
4,869,171 A 9/1989 Abouav
4,884,506 A 12/1989 Guerreri
4,889,183 A 12/1989 Sommers et al.
5,027,708 A 7/1991 Gonzalez et al.
5,038,682 A 8/1991 Marsden
5,052,489 A 10/1991 Carisella et al.
5,060,573 A 10/1991 Montgomery et al.
5,070,788 A 12/1991 Carisella et al.
5,083,929 A 1/1992 Dalton
5,088,413 A 2/1992 Huber et al.
5,090,324 A 2/1992 Bocker et al.
5,105,742 A 4/1992 Sumner
5,119,729 A 6/1992 Nguyen
5,155,296 A 10/1992 Michaluk
5,159,145 A 10/1992 Carisella et al.
5,159,146 A 10/1992 Carisella et al.
5,165,489 A 11/1992 Langston
5,204,491 A 4/1993 Aureal et al.
5,216,197 A 6/1993 Huber et al.
5,322,019 A 6/1994 Hyland
5,347,929 A 9/1994 Lerche et al.
5,366,013 A 11/1994 Edwards et al.
5,392,851 A 2/1995 Arend
5,392,860 A 2/1995 Ross
5,436,791 A 7/1995 Turano et al.
5,479,860 A 1/1996 Ellis
5,503,077 A 4/1996 Motley
5,529,509 A 6/1996 Hayes et al.
5,551,346 A 9/1996 Walters et al.
5,551,520 A 9/1996 Bethel et al.
5,558,531 A 9/1996 Ikeda et al.
5,571,986 A 11/1996 Snider et al.
5,603,384 A 2/1997 Bethel et al.
5,648,635 A 7/1997 Lussier et al.
5,703,319 A 12/1997 Fritz et al.
5,756,926 A 5/1998 Bonbrake et al.
5,759,056 A 6/1998 Costello et al.
5,765,962 A 6/1998 Cornell et al.
5,769,661 A 6/1998 Nealis
5,775,426 A 7/1998 Snider et al.
5,785,130 A 7/1998 Wesson et al.
5,803,175 A 9/1998 Myers, Jr. et al.
5,816,343 A 10/1998 Markel et al.
5,837,925 A 11/1998 Nice
5,859,383 A 1/1999 Davison et al.
5,992,289 A 11/1999 George et al.
6,006,833 A 12/1999 Burleson et al.
6,012,525 A 1/2000 Burleson et al.

(56) References Cited

U.S. PATENT DOCUMENTS 6,085,659 A 7/2000 Beukes et al.
6,112,666 A 9/2000 Murray et al.
6,295,912 B1 10/2001 Burleson et al.
6,297,447 B1 10/2001 Burnett et al.
6,298,915 B1 10/2001 George
6,305,287 B1 10/2001 Capers et al.
6,354,374 B1 3/2002 Edwards et al.
6,408,758 B1 6/2002 Duguet
6,412,415 B1 7/2002 Kothari et al.
6,418,853 B1 7/2002 Duguet et al.
6,439,121 B1 8/2002 Gillingham
6,487,973 B1 12/2002 Gilbert, Jr. et al.
6,497,285 B2 12/2002 Walker
6,618,237 B2 9/2003 Eddy et al.
6,651,747 B2 11/2003 Chen et al.
6,675,896 B2 1/2004 George
6,739,265 B1 5/2004 Badger et al.
6,742,602 B2 6/2004 Trotechaud
6,752,083 B1 6/2004 Lerche et al.
6,772,868 B2 8/2004 Warner
6,843,317 B2 1/2005 Mackenzie
6,851,471 B2 2/2005 Barlow et al.
6,976,857 B1 12/2005 Shukla et al.
7,107,908 B2 9/2006 Forman et al.
7,182,611 B2 2/2007 Borden et al.
7,193,527 B2 3/2007 Hall et al.
7,237,626 B2 7/2007 Gurjar et al.
7,278,491 B2 10/2007 Scott
7,347,278 B2 3/2008 Lerche et al.
7,347,279 B2 3/2008 Li et al.
7,357,083 B2 4/2008 Takahara et al.
7,404,725 B2 7/2008 Hall et al.
7,441,601 B2 10/2008 George et al.
7,481,662 B1 1/2009 Rehrig
7,553,078 B2 6/2009 Hanzawa et al.
7,568,429 B2 8/2009 Hummel et al.
7,661,474 B2 2/2010 Campbell et al.
7,726,396 B2 6/2010 Briquet et al.
7,735,578 B2 6/2010 Loehr et al.
7,748,447 B2 7/2010 Moore
7,752,971 B2 7/2010 Loehr
7,762,172 B2 7/2010 Li et al.
7,762,351 B2 7/2010 Vidal
7,778,006 B2 8/2010 Stewart et al.
7,810,430 B2 10/2010 Chan et al.
7,823,508 B2 11/2010 Anderson et al.
7,908,970 B1 3/2011 Jakaboski et al.
7,929,270 B2 4/2011 Hummel et al.
7,934,453 B2 5/2011 Moore
7,952,035 B2 5/2011 Falk et al.
7,980,874 B2 7/2011 Finke et al.
8,066,083 B2 11/2011 Hales et al.
8,069,789 B2 12/2011 Hummel et al.
8,074,737 B2 12/2011 Hill et al.
8,079,296 B2 12/2011 Barton et al.
8,091,477 B2 1/2012 Brooks et al.
8,127,846 B2 3/2012 Hill et al.
8,157,022 B2 4/2012 Bertoja et al.
8,165,714 B2 4/2012 Mier et al.
8,181,718 B2 5/2012 Burleson et al.
8,182,212 B2 5/2012 Parcell
8,186,259 B2 5/2012 Burleson et al.
8,256,337 B2 9/2012 Hill et al.
8,297,345 B2 10/2012 Emerson
8,327,746 B2 12/2012 Behrmann et al.
8,388,374 B2 3/2013 Grek et al.
8,395,878 B2 3/2013 Stewart et al.
8,449,308 B2 5/2013 Smith
8,451,137 B2 5/2013 Bonavides et al.
8,468,944 B2 6/2013 Givens et al.
8,576,090 B2 11/2013 Lerche et al.
8,578,090 B1 11/2013 Jernigan, IV
8,661,978 B2 3/2014 Backhus et al.
8,689,868 B2 4/2014 Lerche et al.
8,695,506 B2 4/2014 Lanclos
8,863,665 B2 10/2014 DeVries et al.
8,869,887 B2 10/2014 Deere et al.
8,875,787 B2 11/2014 Tassaroli
8,881,816 B2 11/2014 Glenn et al.
8,881,836 B2 11/2014 Ingram
8,884,778 B2 11/2014 Lerche et al.
8,904,935 B1 12/2014 Brown et al.
8,960,093 B2 2/2015 Preiss et al.
8,960,288 B2 2/2015 Sampson
8,985,023 B2 3/2015 Mason
8,997,852 B1 4/2015 Lee et al.
9,080,433 B2 7/2015 Lanclos et al.
9,133,695 B2 9/2015 Xu
9,145,764 B2 9/2015 Burton et al.
9,175,553 B2 11/2015 Mccann et al.
9,181,790 B2 11/2015 Mace et al.
9,194,219 B1 11/2015 Hardesty et al.
9,270,051 B1 2/2016 Christiansen et al.
9,284,819 B2 3/2016 Tolman et al.
9,382,783 B2 7/2016 Langford et al.
9,441,465 B2 9/2016 Tassaroli
9,466,916 B2 10/2016 Li et al.
9,476,289 B2 10/2016 Wells
9,494,021 B2 11/2016 Parks et al.
9,574,416 B2 2/2017 Wright et al.
9,581,422 B2 * 2/2017 Preiss ..... F42C 19/12
9,598,942 B2 3/2017 Wells et al.
9,605,937 B2 * 3/2017 Eitschberger ..... F42C 19/12
9,677,363 B2 6/2017 Schacherer et al.
9,689,223 B2 6/2017 Schacherer et al.
9,689,226 B2 6/2017 Barbee et al.
9,689,233 B2 6/2017 Nguyen et al.
9,702,680 B2 * 7/2017 Parks ..... E21B 43/11855
9,709,373 B2 7/2017 Hikone et al.
9,784,549 B2 * 10/2017 Eitschberger ..... F42D 1/05
9,822,618 B2 11/2017 Eitschberger
9,903,192 B2 2/2018 Entchev et al.
9,926,750 B2 3/2018 Ringgenberg
9,926,755 B2 3/2018 Van Petegem et al.
10,000,994 B1 6/2018 Sites
10,066,921 B2 * 9/2018 Eitschberger ..... F42D 1/05
10,077,641 B2 * 9/2018 Rogman ..... E21B 43/117
10,138,713 B2 11/2018 Tolman et al.
10,151,152 B2 12/2018 Wight et al.
10,151,180 B2 * 12/2018 Robey ..... E21B 43/117
10,188,990 B2 * 1/2019 Burmeister ..... B01D 61/20
10,190,398 B2 1/2019 Goodman et al.
10,273,788 B2 4/2019 Bradley et al.
10,309,199 B2 6/2019 Eitschberger
10,337,270 B2 7/2019 Carisella et al.
10,352,136 B2 7/2019 Goyeneche
10,352,144 B2 7/2019 Entchev et al.
10,429,161 B2 10/2019 Parks et al.
10,429,938 B2 10/2019 Chakra et al.
10,458,213 B1 * 10/2019 Eitschberger ..... E21B 43/1185
10,472,938 B2 11/2019 Parks et al.
10,669,822 B2 6/2020 Eitschberger
10,677,026 B2 * 6/2020 Sokolove ..... E21B 43/1185
2002/0020320 A1 2/2002 Lebaudy et al.
2002/0062991 A1 5/2002 Farrant et al.
2003/0000411 A1 1/2003 Cernocky et al.
2003/0001753 A1 1/2003 Cernocky et al.
2004/0141279 A1 7/2004 Amano et al.
2005/0178282 A1 8/2005 Brooks et al.
2005/0183610 A1 8/2005 Barton et al.
2005/0186823 A1 8/2005 Ring et al.
2005/0194146 A1 9/2005 Barker et al.
2005/0229805 A1 10/2005 Myer, Jr. et al.
2006/0013282 A1 1/2006 Hanzawa et al.
2007/0084336 A1 4/2007 Neves
2007/0125540 A1 6/2007 Gerez et al.
2007/0158071 A1 7/2007 Mooney, Jr. et al.
2008/0047456 A1 2/2008 Li et al.
2008/0047716 A1 2/2008 McKee et al.
2008/0110612 A1 5/2008 Prinz et al.
2008/0121095 A1 5/2008 Han et al.
2008/0134922 A1 6/2008 Grattan et al.
2008/0149338 A1 6/2008 Goodman et al.
2008/0173204 A1 7/2008 Anderson et al.

(56) References Cited

U.S. PATENT DOCUMENTS

2008/0173240 A1 7/2008 Furukawahara et al.
2008/0264639 A1 10/2008 Parrott et al.
2009/0050322 A1 2/2009 Hill et al.
2009/0272519 A1 11/2009 Green et al.
2009/0272529 A1 11/2009 Crawford
2009/0301723 A1 12/2009 Gray
2010/0000789 A1 1/2010 Barton et al.
2010/0089643 A1 4/2010 Vidal
2010/0096131 A1 4/2010 Hill et al.
2010/0163224 A1 7/2010 Strickland
2010/0230104 A1 9/2010 Nolke et al.
2011/0024116 A1 2/2011 McCann et al.
2011/0042069 A1 2/2011 Bailey et al.
2012/0024771 A1 2/2012 Abdalla et al.
2012/0085538 A1 4/2012 Guerrero et al.
2012/0094553 A1 4/2012 Fujiwara et al.
2012/0160491 A1 6/2012 Goodman et al.
2012/0199031 A1 8/2012 Lanclos
2012/0199352 A1 8/2012 Lanclos et al.
2012/0241169 A1* 9/2012 Hales ..... E21B 43/11 166/378
2012/0242135 A1 9/2012 Thomson et al.
2012/0247769 A1 10/2012 Schacherer et al.
2012/0247771 A1 10/2012 Black et al.
2012/0298361 A1 11/2012 Sampson
2013/0008639 A1 1/2013 Tassaroli
2013/0062055 A1 3/2013 Tolman et al.
2013/0118342 A1 5/2013 Tassaroli
2013/0199843 A1 8/2013 Ross
2013/0248174 A1 9/2013 Dale et al.
2014/0033939 A1 2/2014 Preiss et al.
2014/0131035 A1 5/2014 Entchev et al.
2015/0176386 A1 6/2015 Castillo et al.
2015/0226044 A1 8/2015 Ursi et al.
2015/0330192 A1* 11/2015 Rogman ..... E21B 43/116 166/297
2015/0376991 A1 12/2015 Mcnelis et al.
2016/0040520 A1 2/2016 Tolman et al.
2016/0061572 A1* 3/2016 Eitschberger ..... F42C 19/12 89/1.15
2016/0069163 A1 3/2016 Tolman et al.
2016/0084048 A1 3/2016 Harrigan et al.
2016/0168961 A1* 6/2016 Parks ..... E21B 43/117 89/1.15
2016/0273902 A1* 9/2016 Eitschberger ..... F42D 1/05
2016/0281466 A1 9/2016 Richards
2016/0356132 A1* 12/2016 Burmeister ..... B01D 61/20
2017/0030693 A1* 2/2017 Preiss ..... F42C 19/12
2017/0052011 A1* 2/2017 Parks ..... F42D 1/02
2017/0058649 A1 3/2017 Geerts et al.
2017/0074078 A1 3/2017 Eitschberger
2017/0145798 A1* 5/2017 Robey ..... E21B 43/117
2017/0167233 A1 6/2017 Sampson et al.
2017/0199015 A1 7/2017 Collins et al.
2017/0211363 A1 7/2017 Bradley et al.
2017/0241244 A1 8/2017 Barker et al.
2017/0268860 A1* 9/2017 Eitschberger ..... F42D 1/05
2017/0276465 A1 9/2017 Parks et al.
2017/0314372 A1 11/2017 Tolman et al.
2017/0314373 A9 11/2017 Bradley et al.
2018/0030334 A1* 2/2018 Collier ..... E21B 43/117
2018/0038208 A1 2/2018 Eitschberger et al.
2018/0094910 A1 4/2018 Ashton et al.
2018/0135398 A1 5/2018 Entchev et al.
2018/0202789 A1 7/2018 Parks et al.
2018/0202790 A1 7/2018 Parks et al.
2018/0209250 A1* 7/2018 Daly ..... E21B 43/1185
2018/0209251 A1* 7/2018 Robey ..... E21B 43/117
2018/0274342 A1* 9/2018 Sites ..... F42B 3/22
2018/0299239 A1 10/2018 Eitschberger et al.
2018/0306010 A1* 10/2018 Von Kaenel ..... E21B 43/117
2018/0318770 A1* 11/2018 Eitschberger ..... B01D 61/20
2019/0040722 A1* 2/2019 Yang ..... E21B 43/117
2019/0048693 A1 2/2019 Henke et al.
2019/0049225 A1* 2/2019 Eitschberger ..... F42D 1/05
2019/0085685 A1 3/2019 McBride
2019/0162055 A1 5/2019 Collins et al.
2019/0162056 A1 5/2019 Sansing
2019/0195054 A1 6/2019 Bradley et al.
2019/0211655 A1* 7/2019 Bradley ..... E21B 17/042
2019/0234188 A1 8/2019 Goyeneche
2019/0242222 A1 8/2019 Eitschberger
2019/0257181 A1 8/2019 Langford et al.
2019/0284889 A1 9/2019 Lagrange et al.
2019/0292887 A1 9/2019 Austin, II et al.
2019/0316449 A1 10/2019 Schultz et al.
2019/0330961 A1* 10/2019 Knight ..... E21B 43/117
2019/0338612 A1 11/2019 Holodnak et al.
2019/0353013 A1* 11/2019 Sokolove ..... E21B 43/1185
2020/0024934 A1* 1/2020 Eitschberger ..... E21B 47/09
2020/0024935 A1* 1/2020 Eitschberger ..... E21B 47/09
2020/0032626 A1 1/2020 Parks et al.
2020/0063537 A1 2/2020 Langford et al.

FOREIGN PATENT DOCUMENTS

CA 2824838 A1 2/2015
CA 2941648 A1 * 9/2015
CA 2941648 A1 9/2015
CA 3021913 A1 2/2018
CN 85107897 A 9/1986
CN 201209435 3/2009
CN 101397890 A 4/2009
CN 101454635 A 6/2009
CN 201620848 U 11/2010
CN 103485750 A 1/2014
CN 208870580 U 5/2019
CN 209195374 U 8/2019
CN 110424930 A 11/2019
CN 209908471 U 1/2020
DE 102007007498 10/2015
EP 0180520 B1 5/1991
EP 2702349 A4 10/2014
GB 2383236 B 1/2004
GB 2531450 B 2/2017
GB 2548101 A 9/2017
RU 2091567 C1 9/1997
RU 2295694 C2 3/2007
RU 93521 U1 4/2010
RU 100552 U1 12/2010
RU 2434122 C2 11/2011
RU 2633904 C1 10/2017
WO 0159401 A1 8/2001
WO 2001059401 A1 8/2001
WO 2009091422 A2 7/2009
WO 2012006357 A2 1/2012
WO 2012006357 A3 4/2012
WO 2012106640 A3 11/2012
WO 2012149584 A1 11/2012
WO 2014046670 A1 3/2014
WO 2015006869 A1 1/2015
WO 2015028204 A2 3/2015
WO 2015134719 A1 9/2015
WO 2015134719 A8 9/2015
WO 2018009223 A1 1/2018
WO 2019117861 A1 6/2019
WO 2019148009 A2 8/2019
WO 2019204137 A1 10/2019

OTHER PUBLICATIONS

Wade et al., Field Tests Indicate New Perforating Devices Improve Efficiency in Casing Completion Operations, SPE 381, pp. 1069-1073, Oct. 1962, 5 pgs.
SIPO, Search Report dated Mar. 29, 2017, in Chinese: See Search Report for CN App. No. 2014800404569, which is in the same family as U.S. Pat. No. 9,702,680 dated Jul. 11, 2017, 12 pgs.
World Intellectual Property Office, Search Report for GB Patent App. No. GB17006255, which is in the same family as U.S. Pat. No. 9,702,680 dated Jul. 11, 2017, dated Jul. 7, 2017, 5 pages.
GB Intellectual Property Office, Office Action dated Feb. 27, 2018, See Office Action for App. No. GB 1717516.7, which is in the same family as U.S. Pat. No. 9,702,680 dated Jul. 11, 2017, 6 pgs.

(56) References Cited

OTHER PUBLICATIONS

Norwegian Industrial Property Office, Office Action for No. Patent App. No. 20160017, which is in the same family as U.S. Pat. No. 9,702,680 dated Jul. 11, 2017, dated Jun. 15, 2017, 3 pgs.
Norwegian Industrial Property Office, Search Report for No. Patent App. No. 20160017, which is in the same family as U.S. Pat. No. 9,702,680 dated Jul. 11, 2017, dated Jun. 15, 2017, 2 pgs.
FIIP, Search Report dated Feb. 1, 2018, in Russian: See Search Report for RU App. No. 2016104882/03, which is in the same family as U.S. Pat. No. 9,702,680 dated Jul. 11, 2017, 7 pgs.
International Search Report of International Application No. PCT/CA2014/050673, which is in the same family as U.S. Pat. No. 9,702,680 dated Jul. 11, 2017, dated Oct. 9, 2014, 3 pgs.
Amit Govil, Selective Perforation: A Game Changer in Perforating Technology—Case Study, presented at the 2012 European and West African Perforating Symposium, 14 pgs.
UK Examination Report of United Kingdom Patent Application No. GB1600085.3, which is in the same family as U.S. Pat. No. 9,702,680 dated Jul. 11, 2017, dated Mar. 9, 2016, 1 pg.
International Written Opinion of International Application No. PCT/CA2014/050673, which is in the same family as U.S. Pat. No. 9,702,680 dated Jul. 11, 2017, dated Oct. 9, 2014, 4 pgs.
Intellectual Property India, Office Action of IN Application No. 201647004496, which is in the same family as U.S. Pat. No. 9,702,680, dated Jun. 7, 2019, 6 pgs.
Hunting Titan, Inc., U.S. Appl. No. 62/621,999 titled Cluster Gun System and filed Jan. 25, 2018, which is a priority application of International App. No. PCT/US2019/015255 published as WO2019/148009, Aug. 1, 2019, 7 pages, WIPO.
Hunting Titan, Inc., U.S. Appl. No. 62/627,591 titled Cluster Gun System and filed Feb. 7, 2018, which is a priority application of International App. No. PCT/US2019/015255 published as WO2019/148009, Aug. 1, 2019, 7 pages, WIPO.
Hunting Titan, Inc., U.S. Appl. No. 62/736,298 titled Starburst Cluster Gun and filed Sep. 25, 2018, which is a priority application of International App. No. PCT/US2019/015255 published as International Publication No. WO2019/148009, Aug. 1, 2019, 34 pages, WIPO.
Dynaenergetics, Selective Perforating Switch, Product Information Sheet, May 27, 2011, 1 pg.
Dynaenergetics, Electronic Top Fire Detonator, Product Information Sheet, Jul. 30, 2013, 1 pg.
German Patent Office, Office Action for German Patent Application No. 10 2013 109 227.6, which is in the same family as PCT Application No. PCT/EP2014/065752, see p. 5 for references cited, dated May 22, 2014, 8 pgs.
PCT Search Report and Written Opinion, dated May 4, 2015: See Search Report and Written opinion for PCT Application No. PCT/EP2014/065752, 12 pgs.
United States Patent and Trademark Office, Office Action of U.S. Appl. No. 16/585,790, dated Nov. 12, 2019, 9 pgs.
Jim Gilliat/Kaled Gasmi, New Select-Fire System, Baker Hughes, Presentation—2013 Asia-Pacific Perforating Symposium, Apr. 29, 2013, 16 pgs., http://www.perforators.org/presentations.php.
Dynaenergetics, DYNAselect Electronic Detonator 0015 SFDE RDX 1.4S, Product Information, Dec. 16, 2011, 1 pg.
Dynaenergetics, DYNAselect Electronic Detonator 0015 SFDE RDX 1.4B, Product Information, Dec. 16, 2011, 1 pg.
Norwegian Industrial Property Office, Office Action for NO Patent App. No. 20171759, dated Jan. 14, 2020, 4 pgs.
Norwegian Industrial Property Office, Search Report for NO Patent App. No. 20171759, dated Jan. 14, 2020, 2 pgs.
United States Patent and Trademark Office, Office Action of U.S. Appl. No. 15/920,812, dated Dec. 27, 2019, 5 pgs.
Hunting Titan, H-1® Perforating Gun System, 2016, 2 pgs., http://www.hunting-intl.com/titan.
Austin Powder Company, A—140 F & Block, Detonator & Block Assembly, 2 pgs.
Owen Oil Tools & Pacific Scientific; Side Block for Side Initiation, 1 pg.
SIPO, Office Action dated Jun. 27, 2018: See Office Action for CN App. No. 201580011132.7, which is in the same family as PCT App. No. PCT/US2015/18906, 9 pgs. & 5 pgs.
United States Patent and Trademark Office, Final Office Action of U.S. Appl. No. 16/540,484, dated Mar. 30, 2020, which is in the same family as U.S. Appl. No. 16/809,729, 12 pgs.
Dynaenergetics, DYNAselect System, information downloaded from website, Jul. 3, 2013, 2 pgs., http://www.dynaenergetics.com/.
United States Patent and Trademark Office, Non-final Office Action of U.S. Appl. No. 16/451,440, dated Oct. 24, 2019, 22 pgs.
International Search Report and Written Opinion of International Application No. PCT/US2015/018906, dated Jul. 10, 2015, 12 pgs.
Dynaenergetics, Gun Assembly, Products Summary Sheet, May 7, 2004, 1 pg.
United States Patent and Trademark Office, Non-final Office Action of U.S. Appl. No. 16/542,890, dated Nov. 4, 2019, 16 pgs.
Dynaenergetics, Selective Perforating Switch, information downloaded from website, Jul. 3, 2013, 2 pgs.,http://www.dynaenergetics.com/.
Hunting Titan, Wireline Top Fire Detonator Systems, Product Information Sheet, 1 pg.
Hunting Titan Inc., Petition for Inter Parties Review of U.S. Pat. No. 9,581,422, filed Feb. 16, 2018, 93 pgs.
Dynaenergetics GmbH & Co. KG, Patent Owner's Response to Hunting Titan's Petition for Inter Parties Review, filed Dec. 6, 2018, 73 pgs.
Dynaenergetics GmbH & Co. KG, Patent Owner's Motion to Amend, filed Dec. 6, 2018, 53 pgs.
U.S. Patent Trial and Appeal Board, Institution of Inter Partes Review, Case IPR2018-00600, issued on Aug. 21, 2018, 9 pgs.
Owen Oil Tools, Recommended Practice for Oilfield Explosive Safety, Presented at 2011 MENAPS Middle East and North Africa Perforating Symposium, Nov. 28-30, 2011, 6 pages.
Baker Hughes, Long Gun Deployment Systems IPS-12-28, Presented at 2012 International Perforating Symposium, Apr. 26-28, 2011, 11 pages.
Schlumberger, Combining and Customizing Technologies for Perforating Horizontal Wells in Algeria, Presented at 2011 MENAPS Middle East and North Africa Perforating Symposium, Nov. 28-30, 2011, 20 pages.
Smylie, New Safe and Secure Detonators for the Industry's consideration, Presented at Explosives Safety & Security Conference Marathon Oil Co, Houston, Feb. 23-24, 2005, 20 pages.
Horizontal Wireline Services, Presentation of a completion method of shale demonstrated through an example of Marcellus Shale, Pennsylvania, USA, Presented at 2012 International Perforating Symposium (Apr. 26-28, 2012), 17 pages.
Jet Research Center Inc., JRC Catalog, 36 pgs., www.jetresearch.com.
Jet Research Center Inc., Red RF Safe Detonators Brochure, 2008, 2 pgs., www.jetresearch.com.
United States Patent and Trademark Office, Case IPR2018-00600 for U.S. Pat. No. 9,581,422 B2, Order Granting Precedential Opinion Panel, Paper No. 46, dated Nov. 7, 2019, 4 pgs.
United States Patent and Trademark Office, Case IPR2018-00600 for U.S. Pat. No. 9,581,422 B2, Petitioner's Additional Briefing to the Precedential Opinion Panel, dated Dec. 20, 2019, 23 pgs.
IPR2018-00600, Exhibit 3001, Patent Owner's Precedential Opinion Panel Request Letter in regard to Case IPR2018-00600 for U.S. Pat. No. 9,581,422 B2, dated Sep. 18, 2019, 2 pg.
United States Patent and Trademark Office, Final Written Decision of Case IPR2018-00600 for U.S. Pat. No. 9,581,422 B2, Paper No. 42, dated Aug. 20, 2019, 31 pgs.
United States Patent and Trademark Office, Case IPR2018-00600 for U.S. Pat. No. 9,581,422 B2, Patent Owner's Motion to Amend, dated Dec. 6, 2018, 53 pgs.
United States Patent and Trademark Office, Case IPR2018-00600 for U.S. Pat. No. 9,581,422 B2, Patent Owner's Opening Submission to Precedential Opinion Panel, dated Dec. 20, 2019, 21 pgs.
United States Patent and Trademark Office, Case IPR2018-00600 for U.S. Pat. No. 9,581,422 B2, DynaEnergetics GmbH & Co. KG's Patent Owner Preliminary Response, dated May 22, 2018, 47 pgs.

(56) References Cited

OTHER PUBLICATIONS

United States Patent and Trademark Office, Case IPR2018-00600 for U.S. Pat. No. 9,581,422 B2, Patent Owner's Request for Hearing, dated Sep. 18, 2019, 19 pgs.
United States Patent and Trademark Office, Case IPR2018-00600 for U.S. Pat. No. 9,581,422 B2, Patent Owner's Responsive Submission to Precedential Opinion Panel, dated Jan. 6, 2020, 16 pgs.
United States Patent and Trademark Office, Case IPR2018-00600 for U.S. Pat. No. 9,581,422 B2, Patent Owner's Sur-reply, dated Mar. 21, 2019, 28 pgs.
United States Patent and Trademark Office, Case IPR2018-00600 for U.S. Pat. No. 9,581,422 B2, Petitioner's Opposition to Patent Owners Motion to Amend, dated Mar. 7, 2019, 30 pgs.
United States Patent and Trademark Office, Case IPR2018-00600 for U.S. Pat. No. 9,581,422 B2, Petitioner's Reply Briefing to the Precedential Opinion Panel, dated Jan. 6, 2020, 17 pgs.
United States Patent and Trademark Office, Case IPR2018-00600 for U.S. Pat. No. 9,581,422 B2, Petitioner's Reply in Inter Partes Review of Patent No. 9,581,422, dated Mar. 7, 2019, 44 pgs.
United States Patent and Trademark Office, Case IPR2018-00600 for U.S. Pat. No. 9,581,422 B2, Reply in Support of Patent Owner's Motion to Amend, dated Mar. 21, 2019, 15 pgs.
Brazilian Patent and Trademark Office; Search Report for BR Application No. BR112015033010-0; dated May 5, 2020; (4 pages).
Burndy, Bulkhead Ground Connector, Mechanical Summary Sheet, The Grounding Superstore, Jul. 15, 2014, 1 page, https://www.burndy.com/docs/default-source/cutsheets/bulkhead-connect.
Canadian Intellectual Property Office, Office Action for CA App. No. 2923860 dated Jul. 14, 2017, 3 pages.
Canadian Intellectual Property Office, Office Action for CA App. No. 2923860 dated Nov. 25, 2016, 3 pages.
Canadian Intellectual Property Office; Notice of Allowance for CA Appl. No. 2,821,506; dated Jul. 31, 2019; 1 page.
Canadian Intellectual Property Office; Office Action for CA Appl. No. 2,821,506; dated Mar. 21, 2019; 4 pages.
Core Lab, ZERO180™ Gun SystemAssembly and Arming Procedures, 2015, 33 pgs., https://www.corelab.com/owen/CMS/docs/Manuals/gunsys/zero180/MAN-Z180-000.pdf.
Dynaenergetics, Through Wire Grounded Bulkhead (DynaTWG). May 25, 2016, 1 pg., https://www.dynaenergetics.com/uploads/files/5756f884e289a_U233%20DynaTWG%20Bulkhead.pdf.
Dynaenergetics; DynaStage Solution—Factory Assembled Performance-Assured Perforating Systems; 6 pages.
EP Patent Office—International Searching Authority, PCT Search Report and Written Opinion for PCT Application No. PCT/EP2014/065752, dated May 4, 2015, 12 pgs.
United States District Court for the Southern District of Texas Houston Division, Case 4:19-cv-01611 for U.S. Pat. No. 9,581,422B2, Plaintiffs Complaint and Exhibits, dated May 2, 2019, 26 pgs.
European Patent Office; Invitation to Correct Deficiencies noted in the Written Opinion for European App. No. 15721178.0; dated Dec. 13, 2016; 2 pages.
European Patent Office; Office Action for EP App. No. 15721178.0; dated Sep. 6, 2018; 5 pages.
Federal Institute of Industrial Property; Decision of Granting for RU Appl. No. 2016104882/03(007851); May 17, 2018; 15 pages (English translation 4 pages).
Federal Institute of Industrial Property; Decision on Granting a Patent for Invention Russian App. No. 2016139136/03(062394); dated Nov. 8, 2018; 20 pages (Eng Translation 4 pages); Concise Statement of Relevance: Search Report at 17-18 of Russian-language document lists several 'A' references based on RU application claims.
Federal Institute of Industrial Property; Decision on Granting for RU Application No. 2016109329/03; dated Oct. 21, 2019; 11 pages (English translation 4 pages).
Federal Institute of Industrial Property; Decision on Granting for RU Application No. 2019137475/03; dated May 12, 2020; 15 pages (English translation 4 pages).
Federal Institute of Industrial Property; Inquiry for RU App. No. 2016109329/03(014605); issued Jul. 10, 2019; 7 pages (Eng. Translation 5 pages).
Federal Institute of Industrial Property; Inquiry for RU Application No. 2016110014/03(015803); issued Feb. 1, 2018; 6 pages (Eng. Translation 4 pages).
GB Intellectual Property Office; Examination Report for GB Appl. No. 1717516.7; dated Apr. 13, 2018; 3 pages.
GB Intellectual Property Office; Notification of Grant for GB Appl. No. 1717516.7; dated Oct. 9, 2018; 2 pages.
GB Intellectual Property Office; Search Report for GB. Appl. No. 1700625.5; dated Dec. 21, 2017; 5 pages.
GeoDynamics; "Vapr"; promotional brochure; Oct. 1, 2019.
Hunting Energy Service,ControlFire RF Safe ControlFire® RF-Safe Manual, 33 pgs., Jul. 2016, http://www.hunting-intl.com/media/2667160/ControlFire%20RF_Assembly%20Gun%20Loading_Manual.pdf.
Hunting Energy Services Pte Ltd., "H-1 Perforating Gun System"; promotional brochure; Jun. 21, 2019.
Industrial Property Office, Czech Republic; Office Action; CZ App. No. PV 2017-675; dated Dec. 17, 2018; 2 pages.
Instituto Nacional De La Propiedad Industrial; Office Action for AR Appl. No. 20140102653; dated May 9, 2019 (1 page).
International Searching Authority; International Preliminary Report on Patentability for PCT Appl. No. PCT/CA2014/050673; dated Jan. 19, 2016; 5 pages.
International Searching Authority; International Search Report and Written Opinion for PCT App. No. PCT/EP2015/059381; dated Nov. 23, 2015; 14 pages.
International Searching Authority; International Search Report and Written Opinion for PCT App. No. PCT/EP2019/069165; dated Oct. 22, 2019; 13 pages.
Thilo Scharf; "DynaStage & BTM Introduction"; pp. 4-5, 9; presented at 2014 Offshore Technology Conference; May 2014.
Jet Research Center, Velocity™ Perforating System Plug and Play Guns for Pumpdown Operation, Ivarado, Texas, Jul. 2019, 8 pgs., https://www.jetresearch.com/content/dam/jrc/Documents/Brochures/jrc-velocity-perforating-system.pdf.
Mcnelis et al.; High-Performance Plug-and-Pert Completions in Unconventional Wells; Society of Petroleum Engineers Annual Technical Conference and Exhibition; Sep. 28, 2015.
Norwegian Industrial Property Office; Office Action for NO Appl. No. 20160017; dated Dec. 4, 2017; 2 pages.
Norwegian Industrial Property Office; Opinion for NO Appl. No. 20171759; dated Apr. 5, 2019; 1 page.
Oso Perforating; "OsoLite"; promotional brochure; Jan. 2019.
Owen Oil Tools, Expendable Perforating Guns, Jul. 2008, 7 pgs., https://www.corelab.com/owen/cms/docs/Canada/10A_erhsc-01.0-c.pdf.
Owens Oil Tools, E & B Select Fire Side Port Tandem Sub Assembly, 2009, 9 pgs., https://www.corelab.com/owen/CMS/docs/Manuals/gunsys/MAN-30-XXX-0002-96-R00.pdf.
State Intellectual Property Office People's Republic of China; First Office Action for Chinese App. No. 201811156092.7; dated Jun. 16, 2020; 6 pages (Eng Translation 8 pages).
State Intellectual Property Office, P.R. China; First Office Action for Chinese App. No. 201610153426.X; dated Mar. 20, 2019; 6 pages (Eng Translation 11 pages).
State Intellectual Property Office, P.R. China; First Office Action for CN App. No. 201480047092.7; dated Apr. 24, 2017.
State Intellectual Property Office, P.R. China; First Office Action with full translation for CN App. No. 201480040456.9; dated Mar. 29,2017; 12 pages (English translation 17 pages).
State Intellectual Property Office, P.R. China; Notification to Grant Patent Right for Chinese App. No. 201580011132.7; dated Apr. 3, 2019; 2 pages (Eng. Translation 2 pages).
State Intellectual Property Office, P.R. China; Notification to Grant Patent Right for CN App. No. 201480040456.9; dated Jun. 12, 2018; 2 pages (English translation 2 pages).
State Intellectual Property Office, P.R. China; Second Office Action for CN App. No. 201480040456.9; dated Nov. 29, 2017; 5 pages (English translation 1 page).

(56) References Cited

OTHER PUBLICATIONS

State Intellectual Property Office, P.R. China; Second Office Action for CN App. No. 201480047092.7; dated Jan. 4, 2018; 3 pages.
SWM International Inc.; "Thunder Disposable Gun System"; promotional brochure; Oct. 2018; 5 pgs.
Thilo Scharf; "DynaEnergetics exhibition and product briefing"; pp. 5-6; presented at 2014 Offshore Technology Conference; May 2014.
United States District Court for the Southern District of Texas Houston Division, Case 4:19-cv-01611 for U.S. Pat. No. 9,581,422B2, Defendant's Answers, Counterclaims and Exhibits, dated May 28, 2019, 135 pgs.
United States District Court for the Southern District of Texas Houston Division, Case 4:19-cv-01611 for U.S. Pat. No. 9,581,422B2, Plaintiffs' Motion to Dismiss and Exhibits, dated Jun. 17, 2019, 63 pgs.
United States Patent and Trademark Office, Office Action of U.S. Appl. No. 15/617,344, dated Jan 23, 2019, 5 pgs.
United States Patent and Trademark Office, Office Action of U.S. Appl. No. 15/788,367, dated Oct. 22, 2018, 6 pgs.
United States Patent and Trademark Office, Office Action of U.S. Appl. No. 15/920,800, dated Dec. 27, 2019, 6 pgs.
United States Patent and Trademark Office, Office Action of U.S. Appl. No. 15/920,812, dated Dec. 27, 2019, 6 pgs.
United States Patent and Trademark Office, Office Action of U.S. Appl. No. 15/920,812, dated May 27, 2020, 5 pgs.
United States Patent and Trademark Office, Office Action of U.S. Appl. No. 16/423,789, dated Feb. 18, 2020, 14 pgs.
United States Patent and Trademark Office, Office Action of U.S. Appl. No. 16/511,495, dated Aug. 27, 2020, 20 pgs.
United States Patent and Trademark Office; Notice of Allowance for U.S. Appl. No. 15/920,812, dated Aug. 18, 2020; 5 pages.
United States Patent and Trademark Office; Notice of Allowance for U.S. Appl. No. 16/585,790, dated Aug. 5, 2020; 15 pages.
United States Patent and Trademark Office; Notice of Allowance for U.S. Appl. No. 15/920,800; dated Jul. 7, 2020; 7 pages.
United States Patent and Trademark Office; Notice of Allowance for U.S. Appl. No. 16/423,789; dated Jul. 23, 2020 7 pages.
United States Patent and Trademark Office; Office Action of U.S. Appl. No. 16/540,484, dated Aug. 20, 2020, 10 pgs.
USPTO; Notice of Allowance for U.S. Appl. No. 14/904,788; dated Jul. 6, 2016; 8 pages.
USPTO; Supplemental Notice of Allowability for U.S. Appl. No. 14/904,788; dated Jul. 21, 2016; 2 pages.
Vigor USA; "Sniper Addressable System"; promotional brochure; Sep. 2019.
Canadian Intellectual Property Office; First Office Action for CA App. No. 2933756; dated May 25, 2017; 2 pages.
Canadian Intellectual Property Office; Fourth Office Action for CA App. No. 2933756; dated May 31, 2019; 3 pages.
Canadian Intellectual Property Office; Second Office Action for CA App. No. 2933756; dated Jan. 29, 2018; 3 pages.
Canadian Intellectual Property Office; Third Office Action for CA App. No. 2933756; dated Jul. 31, 2018; 2 pages.
Corelab, RF-Safe Green Detonator, Data Sheet, Jul. 26, 2017, 2 pages.
Dynaenergetics Europe; Complaint and Demand for Jury Trial, Civil Action No. 6:20-cv-00069; dated Jan. 30, 2020; 9 pages.
Dynaenergetics Europe; Complaint and Demand for Jury Trial,Civil Action No. 4:17-cv-03784; dated Dec. 14, 2017; 7 pages.
Dynaenergetics Europe; Exhibit B Invalidity Claim Chart for Civil Action No. 4:19-cv-01611; dated May 2, 2019; 52 pages.
Dynaenergetics Europe; Exhibit C Invalidity Claim Chart for Civil Action No. 4:17-cv-03784; dated Jul. 13, 2020; 114 pages.
Dynaenergetics Europe; Plaintiffs' Local Patent Rule 3-1 Infringement Contentions for Civil Action No. 4:19-cv-01611; dated May 25, 2018; 10 Pages.
Dynaenergetics Europe; Plaintiffs' Motion to Dismiss Defendants' Counterclaim and to strike Affirmative Defenses, Civil Action No. 4:17-cv-03784; dated Feb. 20, 2018; 9 pages.
Dynaenergetics Europe; Plaintiffs' Preliminary Claim Constructions and Identification of Extrinsic Evidence Civil Action No. 4:17-cv-03784; dated Aug. 3, 2018; 9 pages.
Dynaenergetics Europe; Plaintiffs' Preliminary Infringement Contentions, Civil Action No. 6:20-cv-00069-ADA; dated Apr. 22, 2020; 4 pages.
Dynaenergetics Europe; Plaintiff's Preliminary Infringement Contentions; Apr. 22, 2020; 32 pages.
Dynaenergetics Europe; Plaintiffs' Reply in Support of Motion to Dismiss and Strike for Civil Action No. 6:20-cv-00069-ADA; dated Apr. 29, 2020; 15 pages.
Dynaenergetics Europe; Plaintiffs Response to Defendant Hunting Titan Ins' Inoperative First Amended Answer, Affirmative Defenses, and Counterclaims for Civil Action No. 6:20-cv-00069-ADA; dated May 13, 2020.
Dynaenergetics Europe; Plaintiffs' Response to Defendants' Answer to Second Amended Complaint Civil Action No. 6:20-cv-00069-ADA; dated May 26, 2020; 18 pages.
European Patent Office; First Office Action for EP App. No. 15796416.4; dated Nov. 4, 2016; 2 pages.
European Patent Office; Second Office Action for EP App. No. 15796416.4; dated Sep. 26, 2017; 4 pages.
European Patent Office; Third Office Action for EP App. No. 15796416.4; dated Jul. 19, 2018; 3 pages.
Farinago, et al.; Long Gun Deployment Systems IPS-12-28; presented at International Perforating Symposium, Apr. 26-28, 2012; 11 pages.
Hunting Titan Ltd.; Petition for Inter Partes Review of U.S. Pat. No. 9,581,422 Case No. IPR2018-00600; dated Feb. 16, 2018; 93 pages.
Hunting Titan Ltd.; Defendants' Answer and Counterclaims, Civil Action No. 4:19-cv-01611; dated May 28, 2019; 21 pages.
Hunting Titan Ltd.; Defendants' Answer and Counterclaims, Civil Action No. 6:20-cv-00069; dated Mar. 17, 2020; 30 pages.
Hunting Titan Ltd.; Defendants' Answer to First Amended Complaint and Counterclaims, Civil Action No. 6:20-cv-00069; dated Apr. 6, 2020; 30 pages.
Hunting Titan Ltd.; Defendants' Answer to Second Amended Complaint and Counterclaims, Civil Action No. 6:20-cv-00069; dated May 12, 2020; 81 pages.
Hunting Titan Ltd.; Defendants Invalidity Contentions Pursuant to Patent Rule 3-3, Civil Action No. 4:17-cv-03784; dated Jul. 6, 2018; 29 pages.
Hunting Titan Ltd.; Defendants' Objections and Responses to Plaintiffs' First Set of Interrogatories, Civil Action No. 4:17-cv-03784; dated Jun. 11, 2018.
Hunting Titan Ltd.; Defendants' Opposition to Plaintiffs' Motion to Dismiss and Strike Defendants' Amended Counterclaim and Affirmative Defenses for Unenforceability due to Inequitable Conduct for Civil Action No. 4:17-cv-03784; dated Apr. 24, 2018; 8 pages.
Parrot, Robert; Declaration, PGR 2020-00080; dated Aug. 11, 2020; 400 pages.
Schlumberger; Selective Perforation: A Game Changer in Perforating Technology—Case Study; issued 2012; 14 pages.
Tom Smylie, New Safety Detonators for the Industry's consideration, presented at Explosives Safety & Security Conference, Feb. 23-24, 2005, 20 pages.
United States Patent and Trademark Office, U.S. Appl. No. 61/733,129, filed Dec. 4, 2012; 10 pages.
United States Patent and Trademark Office, U.S. Appl. No. 61/819,196, filed May 3, 2013; 10 pages.
United States Patent and Trademark Office; Final Office Action for U.S. Appl. No. 16/299,952; dated May 15, 2020; 10 pages.
United States Patent and Trademark Office; Non-Final Office Action for U.S. Appl. No. 16/299,952; dated Oct. 18, 2019; 12 pages.
United States Patent and Trademark Office; Notice of Allowability for U.S. Appl. No. 14/908,788; dated Dec. 27, 2017; 5 pages.
United States Patent and Trademark Office; Notice of Non-Compliant Amendment for U.S. Appl. No. 16/299,952; dated Apr. 23, 2020; 2 pages.
United States Patent and Trial Appeal Board; Final Written Decision on IPR2018-00600; dated Aug. 20, 2019; 31 pages.

* cited by examiner

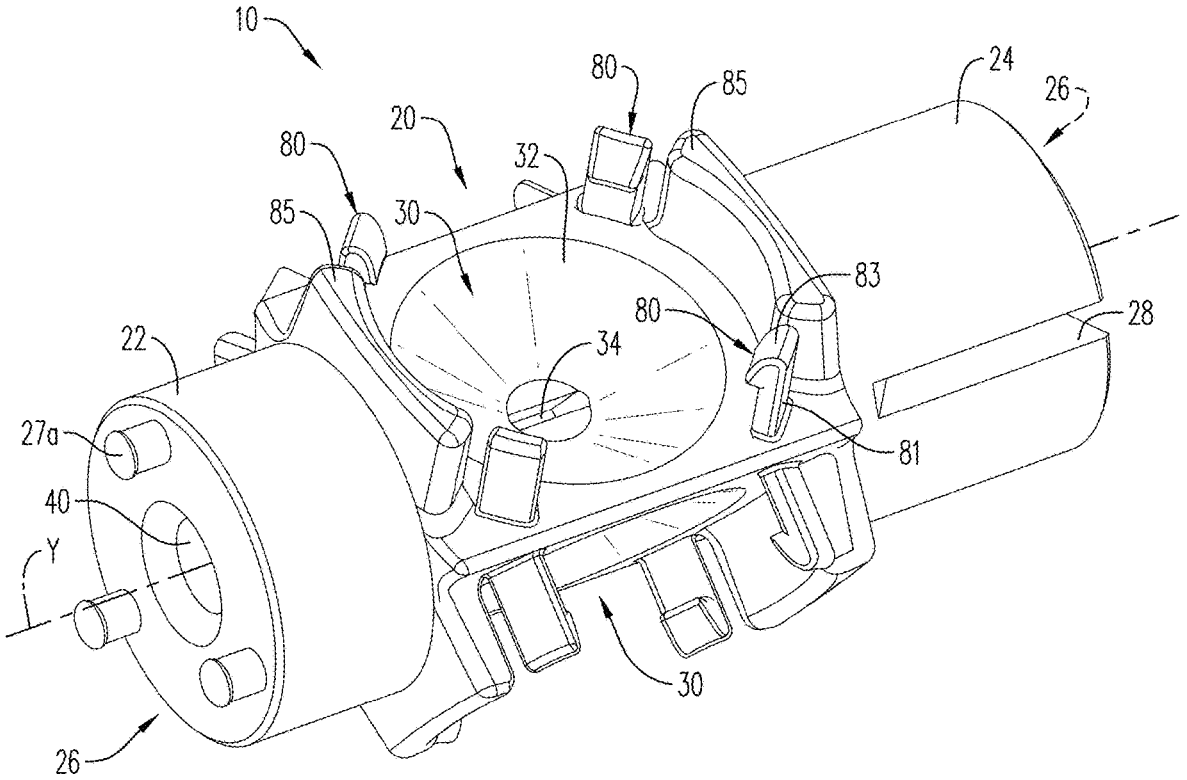
FIG. 2
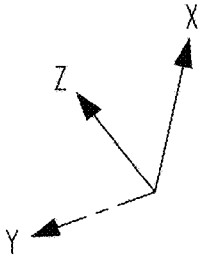

POSITIONING DEVICE FOR SHAPED CHARGES IN A PERFORATING GUN MODULE

CROSS-REFERENCE TO RELATED APPLICATIONS

The present application is a continuation of U.S. application Ser. No. 16/272,326 filed Feb. 11, 2019, which claims the benefit of U.S. Provisional Application No. 62/699,484 filed Jul. 17, 2018 and U.S. Provisional Application No. 62/780,427 filed Dec. 17, 2018, each of which is incorporated herein by reference in its entirety.

BACKGROUND OF THE DISCLOSURE

Hydrocarbons, such as fossil fuels (e.g. oil) and natural gas, are extracted from underground wellbores extending deeply below the surface using complex machinery and explosive devices. Once the wellbore is established by placement of casing pipes after drilling, a perforating gun assembly, or train or string of multiple perforating gun assemblies, are lowered into the wellbore, and positioned adjacent one or more hydrocarbon reservoirs in underground formations.

Assembly of a perforating gun requires assembly of multiple parts. Such parts typically include a housing or outer gun barrel. An electrical wire for communicating from the surface to initiate ignition, a percussion initiator and/or a detonator, a detonating cord, one or more charges which are held in an inner tube, strip or carrying device and, where necessary, one or more boosters are typically positioned in the housing. Assembly of the perforating gun typically includes threaded insertion of one component into another by screwing or twisting the components into place. Tandem seal adapters/subs are typically used in conjunction with perforating gun assemblies to connect multiple perforating guns together. The tandem seal adapters are typically configured to provide a seal between adjacent perforating guns. Some tandem seal adapters may be provided internally or externally between adjacent perforating guns, which, in addition to requiring the use of multiple parts or connections between the perforating guns, may increase the length of each perforating gun and may be more expensive to manufacture. One such system is described in PCT Publication No. WO 2015/179787A1 assigned to Hunting Titan Inc.

The perforating gun includes explosive charges, typically shaped, hollow or projectile charges, which are initiated to perforate holes in the casing and to blast through the formation so that the hydrocarbons can flow through the casing. The explosive charges may be arranged in a hollow charge carrier or other holding devices. Once the perforating gun(s) is properly positioned, a surface signal actuates an ignition of a fuse or detonator, which in turn initiates a detonating cord, which detonates the explosive charges to penetrate/perforate the casing and thereby allow formation fluids to flow through the perforations thus formed and into a production string. Upon detonation of the explosive charges, debris typically remains inside the casing/wellbore. Such debris may include shrapnel resulting from the detonation of the explosive charges, which may result in obstructions in the wellbore. Perforating gun assemblies may be modified with additional components, end plates, internal sleeves, and the like in an attempt to capture such debris. U.S. Pat. No. 7,441,601 to GeoDynamics Inc., for example, describes a perforating gun assembly having an inner sleeve configured with pre-drilled holes that shifts in relation to an outer gun barrel upon detonation of the explosive charges in the perforating gun, to close the holes formed by the explosive charges. Such perforating gun assemblies require numerous components, may be costly to manufacture and assemble, and may reduce/limit the size of the explosive charges, in relation to the gun diameter, which may be compatible with the gun assembly.

There is a need for an improved perforating gun assembly that does not require the use of tandem seal adapters or tandem subs to facilitate a sealed connection between perforating gun assemblies. There is a further need for a perforating gun assembly that includes an efficient design for capturing debris resulting from detonation of a plurality of shaped charges.

BRIEF DESCRIPTION OF THE EXEMPLARY EMBODIMENTS

Embodiments of the disclosure are associated with a positioning device. The positioning device includes a shaped charge holder configured for arranging/positioning a plurality of shaped charges therein. According to an aspect, the shaped charges are positioned in an XZ-plane, in an outward, radial arrangement about a central-axis/Y-axis/central Y-axis of the shaped charge holder. The shaped charges may be designed so that, regardless of their sizes, they create perforating tunnels having a geometry (such as a length and width) that cumulatively facilitates a flow rate that is equivalent to the flow rate facilitated by other shaped charges of different sizes. Each shaped charge includes an open front end, and a back wall including an initiation point. A detonator may be positioned centrally within the shaped charge holder, adjacent the initiation point. According to an aspect, the detonator is a wireless detonator and the shaped charges are directly initiated by the detonator in response to an initiation signal.

The present embodiments may further be associated with a positioning device for a plurality of shaped charges. The positioning device includes a first end and a second end, and a shaped charge holder extending between the first and second ends. The shaped charge holder includes a plurality of shaped charge receptacles radially arranged in an XZ-plane about a Y-axis of the shaped charge holder. Each of the receptacles is configured for receiving one of the shaped charges, so that the received shaped charges are similarly radially arranged in the XZ-plane about the central Y-axis of the shaped charge holder. According to an aspect, the shaped charge receptacles include a depression and an opening formed in the depression. An elongated cavity may extend through the positioning device from the first end to the second end. The elongated cavity is adjacent each of the shaped charge receptacles and is in communication with the elongated opening. According to an aspect, a detonator is positioned in the elongated opening and configured to initiate the shaped charges simultaneously, in response to an initiation signal.

Further embodiments of the disclosure may be associated with a positioning device including a first end, a second end, and an elongated cavity/lumen extending through the positioning device from the first end to the second end. A shaped charge holder is included in the positioning device and extends between the first and second ends. The shaped charge holder is configured substantially as described hereinabove, and each of its shaped charge receptacles is configured for receiving one of the shaped charges. According to an aspect, the elongated opening of the positioning device is configured for retaining a detonator therein and is adjacent the shaped charge receptacles. The arrangement of the detonator in the elongated opening facilitates direct and simultaneous initiation of the shaped charges via the detonator, which may occur in response to an initiation signal. According to an aspect, the positioning device may further include at least one rib. The rib outwardly extends from the positioning device. When the holder is positioned in a perforating gun module/carrier, the fin may engage with an inner surface of the perforating gun module to prevent movement of the positioning device, and thus the shaped charges, vertically in the perforating gun module.

Embodiments of the disclosure may further be associated with a shaped charge for use with a shaped charge holder, or a positioning device including a shaped charge holder, configured substantially as described hereinabove. The shaped charge includes a substantially cylindrical/conical case having an open front end, and a back wall having an initiation point extending there through, and at least one cylindrical side wall extending between the open front end and the back wall. An explosive load is disposed within the hollow interior of the case, and is positioned so that it is adjacent at least a portion of an internal surface of the case. According to an aspect, a liner is pressed into or positioned over the explosive load. The liner may be seated within the case adjacent the internal surface to enclose the explosive load therein. According to an aspect, at least one of the internal surface, the liner geometry and/or liner constituents, and the explosive load is modified to change the shape of a perforating jet formed upon detonation of the shaped charge. The resulting perforation jet creates a perforating tunnel that has a geometry that facilitates a flow rate or hydraulic fracturing that is equivalent to the flow rate or the hydraulic fracturing typically facilitated by another shaped charge of a different size or composition. According to an aspect, the side wall includes an engagement member outwardly extending from an external surface of the side wall. The engagement member is configured for coupling the shaped charge within a shaped charge receptacle of a shaped charge holder configured substantially as described herein. The shaped charge does not require the use of detonating cord guides at the back of the shaped charge and eliminates the need for a turning process during manufacture of the shaped charge. This may result in reduced manufacturing costs as the shaped charge has less contoured surfaces as standard shaped charges.

Further embodiments of the disclosure may be associated with a perforating gun module. The perforating gun module includes a housing having a first housing end and a second housing end. A chamber extends from the first housing end towards the second housing end, and a positioning device is secured in the chamber. The positioning device may be configured substantially as defined hereinabove. According to an aspect, the positioning devices includes the shaped charge holder including shaped charge receptacles that are radially arranged in an XZ-plane about a Y-axis of the shaped charge holder. The positioning device includes at least one rib extending therefrom and engaging with an inner surface of the housing of the perforating gun module, thereby reducing movement of the positioning device, and thus the orientation of the shaped charges, within the perforating gun module. The shaped charge holder may be configured to house and retain a detonator in an elongated cavity, and a plurality of shaped charges may be arranged in the shaped charge receptacles. The detonator is arranged so that it is directly energetically coupled to the shaped charges, which may eliminate the requirement for use of a detonating cord to activate the shaped charges. According to an aspect, the housing of the housing of the perforating gun module is specially designed to capture a resulting mass created by the activation of the shaped charges. This helps to minimize debris that may remain in the wellbore after detonation of the shaped charges.

Embodiments of the disclosure may further be associated with a method of making the perforating gun module described herein. The method includes forging a housing from a solid metal material and providing a positioning device for being received in a chamber of the housing. According to an aspect, the positioning device is formed from an injection molded, casted, or 3D printed plastic material or 3-D milled and cut from solid plastic bar stock. The positioning device may be configured substantially as described hereinabove. The positioning device is arranged within a chamber of the housing so that the shaped charges are positioned in an XZ-plane, in an outward, radial arrangement, about a Y-axis of the shaped charge holder.

BRIEF DESCRIPTION OF THE DRAWINGS

A more particular description will be rendered by reference to specific embodiments thereof that are illustrated in the appended drawings. Understanding that these drawings depict only typical embodiments thereof and are not therefore to be considered to be limiting of its scope, exemplary embodiments will be described and explained with additional specificity and detail through the use of the accompanying drawings in which:

FIG. 2 is a side, perspective view of the positioning device of FIG. 1;

Figure 1:
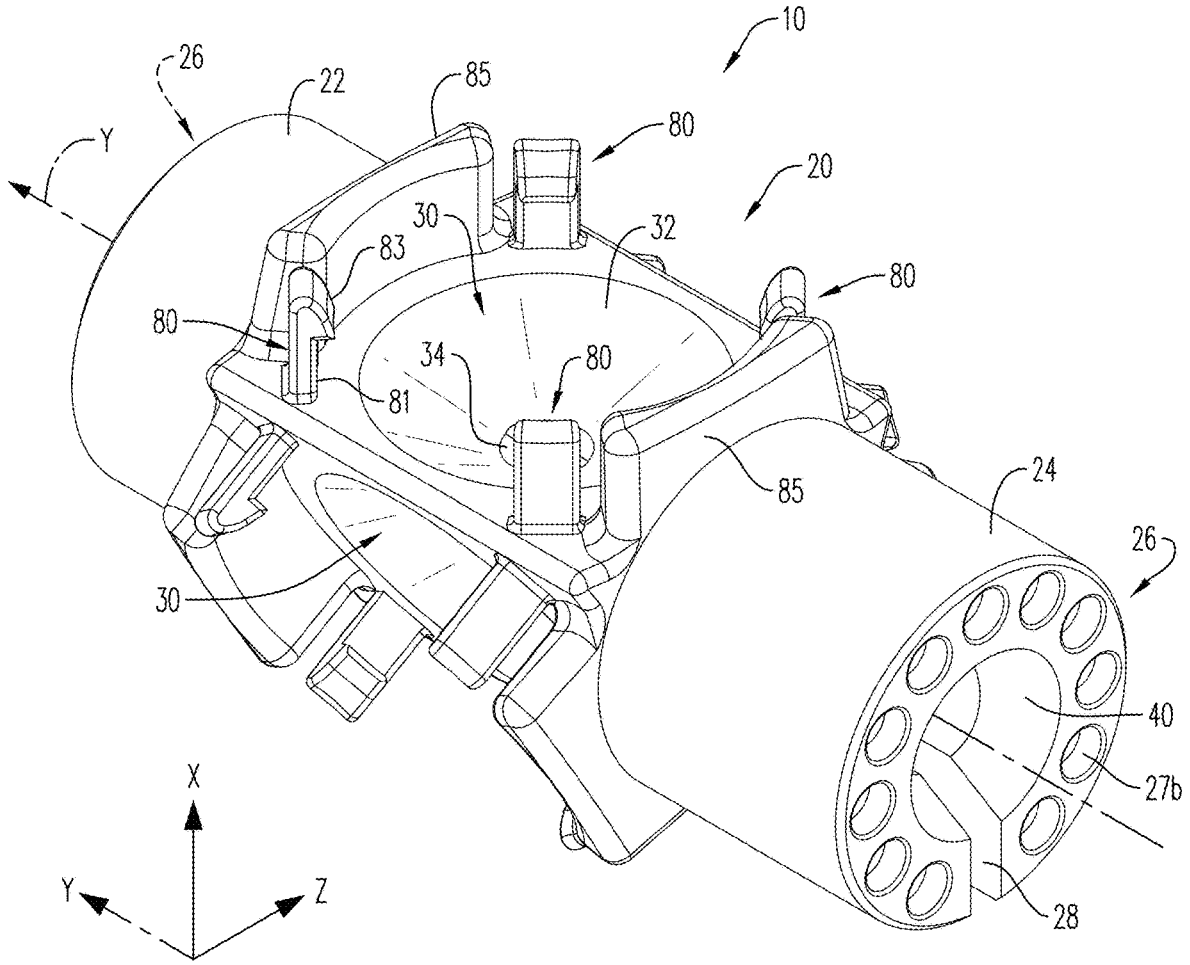
FIG. 1 is a perspective view of a positioning device, according to an embodiment.

Various features, aspects, and advantages of the embodiments will become more apparent from the following detailed description, along with the accompanying figures in which like numerals represent like components throughout the figures and text. The various described features are not necessarily drawn to scale, but are drawn to emphasize specific features relevant to some embodiments.

The headings used herein are for organizational purposes only and are not meant to limit the scope of the description or the claims. To facilitate understanding, reference numerals have been used, where possible, to designate like elements common to the figures.

DETAILED DESCRIPTION

Reference will now be made in detail to various embodiments. Each example is provided by way of explanation and is not meant as a limitation and does not constitute a definition of all possible embodiments.

As used herein, the term "energetically" may refer to a detonating/detonative device that, when detonated/or activated, generates a shock wave impulse that is capable of reliably initiating an oilfield shaped charge, booster or section of detonating cord to a high order detonation.

The terms "pressure bulkhead" and "pressure bulkhead structure" shall be used interchangeably, and shall refer to an internal, perforating gun housing compartment of a select fire sub assembly. In an embodiment, it also contains a pin assembly and allows the electrical passage of a wiring arrangement. The bulkhead structures may include at least one electrically conductive material within its overall structure.

For purposes of illustrating features of the embodiments, simple examples will now be introduced and referenced throughout the disclosure. Those skilled in the art will recognize that these examples are illustrative and not limiting and are provided purely for explanatory purposes. As other features of a perforating gun assembly are generally known (such as detonator and shaped charge design structures), for ease of understanding of the current disclosure those other features will not be otherwise described herein except by reference to other publications as may be of assistance.

FIGS. 1-2 illustrate a positioning device 10 configured for arranging a plurality of shaped charges 120 (FIG. 6) in a selected configuration. The shaped charges 120 may be positioned in an XZ-plane, in an outward, radial arrangement, about a Y-axis of the shaped charge holder 20; the Y-axis in the figures is the central axis of the shaped charge holder 20. The positioning device 10 may be configured as a unitary structure formed from a plastic material. According to an aspect, the positioning device 10 is formed from an injection molded material, a casted material, a 3D printed or 3-D milled material, or a machine cut solid material. Upon detonation of the shaped charges 120 positioned in the shaped charge holder 20, the positioning device may partially melt/soften to capture any shrapnel and dust generated by the detonation.

The positioning device 10 includes a first end 22 and a second end 24, and a shaped charge holder 20 extending between the first and second ends 22, 24. According to an aspect, the shaped charge holder 20 includes a plurality of shaped charge receptacles 30. The receptacles 30 are arranged between the first and second ends 22, 24 of the positioning device 10. The shaped charge receptacles 30 may be radially arranged in the XZ-plane about the Y-axis, i.e., central axis, of the shaped charge holder 20, each being configured to receive one of the shaped charges 120.

Figure 5:
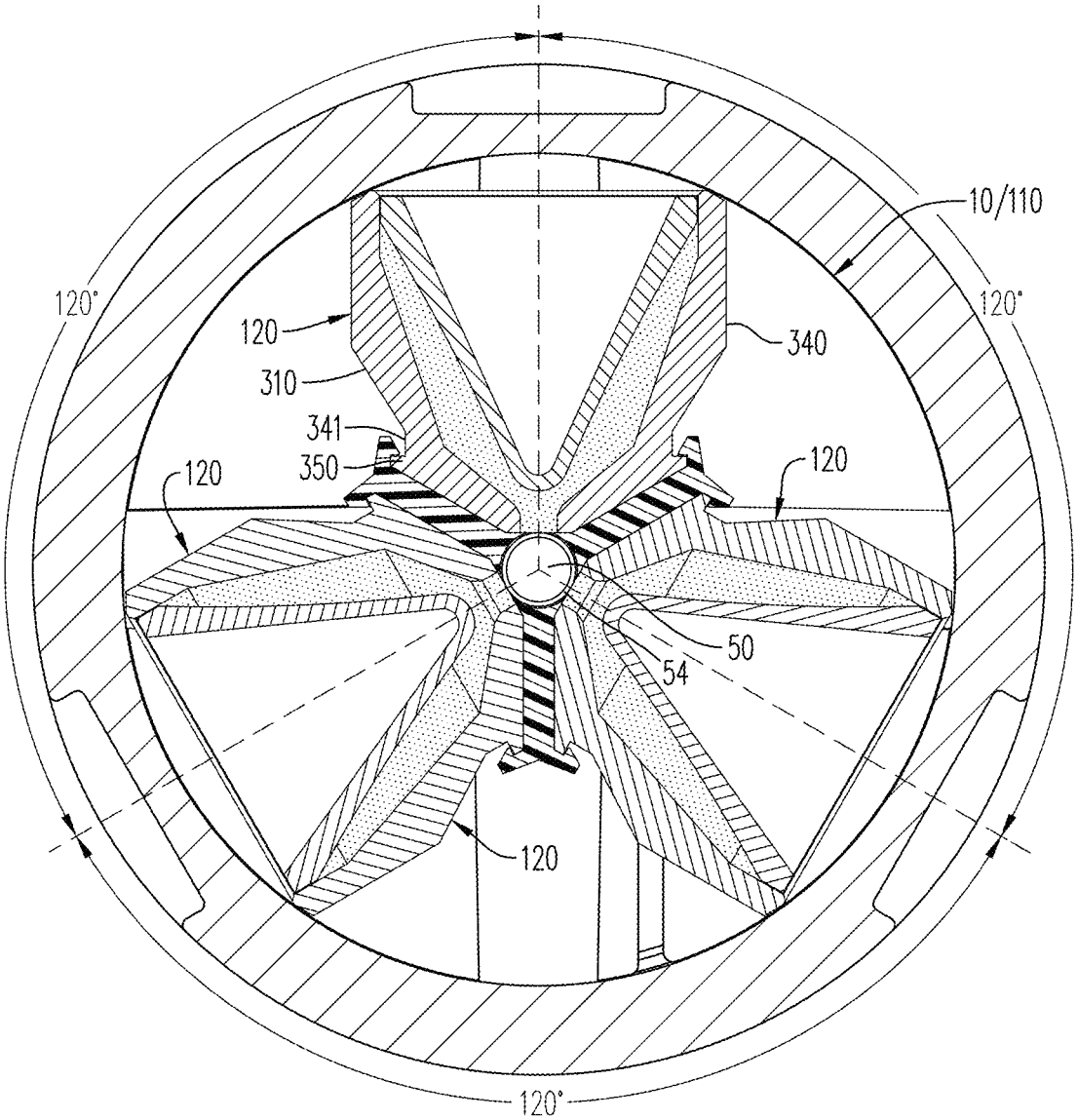
FIG. 5 is a cross-sectional view of a positioning device, illustrating a plurality of shaped charges positioned in shaped charge receptacles, according to an aspect.

According to an aspect, the shaped charge receptacles 30 may include a depression/recess 32 that extends inwardly into the positioning device 10. An opening/slot 34 is formed in the depression 30. The opening 34 is configured to facilitate communication between contents of the depression 32 (i.e., the shaped charges 120) and a detonative device that extends through the positioning device 10. In an embodiment and as illustrated in FIG. 5, the opening 34 of each of the shaped charge receptacles 30, and the shaped charges 120, is spaced from about 60° to about 120° from each other. According to an aspect, the shaped charge receptacles 30 may be spaced apart from each other equidistantly, which may aid in reducing the formation breakdown pressure during hydraulic fracturing. The positioning device 10 may include 2, 3, 4, 5, 6 or more receptacles 30, depending on the needs of the application.

The shaped charge receptacles 30 may be configured to receive shaped charges 120 of different configurations and/or sizes. As would be understood by one of ordinary skill in the art, the geometries of the perforating jets and/or perforations (holes or perforating holes) that are produced by the shaped charges 120 upon detonation depends, at least in part, on the shape of the shaped charge case, the shape of the liner and/or the blend of powders included in the liner. The geometries of the perforating jets and holes may also depend on the quantity and type of explosive load included in the shaped charge. The shaped charges 120 may include, for example, substantially the same explosive gram weight, the interior surface of the shaped charge case and/or the design of the liner may differ for each shaped charge 120 in order to produce differently sized or shaped perforations.

According to an aspect, the receptacles 30 are configured to receive at least one of 3 g to 61 g shaped charges. It is contemplated, for example, that the receptacles may be sized to receive 5 g, 10 g, 26 g, 39 g and 50 g shaped charges 120. Adjusting the size of the shaped charges 120 (and thereby the quantity of the explosive load in the shaped charges 120) positioned in the shaped charge receptacles 30 may impact the size of the entrance holes/perforations created in a target formation upon detonation of the shaped charges 120.

The positioning device 10 may include three (3) shaped charges receptacles 30, with a shaped charge 120 being positioned in each receptacle 30. Upon detonation of the shaped charges 120, three (3) perforating holes having an equal entrance hole diameter of an amount ranging from about 0.20 inches to about 0.55 inches are formed. To be sure, the equal entrance hole diameter of the perforations will include a deviation of less than 10%. For example, three specially designed shaped charges 120, each including 10 g of explosive load, may be installed in a positioning device 10. Upon detonation of these shaped charges 120, they may perform equivalent to a standard shaped charge carrier that has three standard shaped charges that each include 22.7 g explosive load. The enhanced performance of the specially designed shaped charges 120 may be facilitated, at least in part, may the type of explosive powder selected for the explosive load, the shape and constituents of the liner and the contours/shape of the internal surface of the shaped charge case.

The combined surface area of the hole diameters may be equivalent to the total surface area that would be formed by an arrangement of 2, 4, 5, 6 or more standard shaped charges of a standard perforating gun. The ability of the shaped charge receptacles 30 to receive shaped charges 120 of different sizes or components helps to facilitate a shot performance that is equivalent to that of a traditional shaped charge carrier including 2, 4, 5, 6 or more shaped charges. Thus, without adjusting the quantity/number of the shaped charges 120 and/or the receptacles 30 of the positioning device 10, the total surface area of the perforations (i.e., the area open to fluid flow) created by detonating the shaped charges 120 is effectively adjusted based on the size and type of the shaped charges 120 utilized in the positioning device 10. This may facilitate a cost-effective and efficient way of adjusting the optimal flow path for fluid in the target formation, without modifying the arrangement or quantity of the receptacles 30.

According to an aspect, the positioning device 10 includes one or more mechanisms that help to guide and/or secure the shaped charges within the shaped charge receptacles 30. The positioning device may include a plurality of shaped charge positioning blocks/bars 85 outwardly extending from the shaped charge holder 20. The positioning blocks 85 may help to guide the arrangement, mounting or placement of the shaped charges 120 within the shaped charge receptacles 30. The positioning blocks 85 may be contoured to correspond to a general shape of the shaped charges 120, such as conical or rectangular shaped charges. According to an aspect, the positioning blocks 85 provides added strength and stability to the shaped charge holder 20 and helps to support the shaped charges 120 in the shaped charge holder 20.

According to an aspect, the positioning device 10 further includes a plurality of retention mechanisms 80 outwardly extending from the holder 20. The retention mechanisms 80 may be adjacent each of the shaped charge receptacles 30. As illustrated in FIG. 1 and FIG. 2, the retention mechanisms 80 may be arranged in a spaced apart configuration from each other. Each retention mechanism 80 may be adjacent one shaped charge positioning block 85. For instance, each member of a pair of the retention mechanisms 80 may be spaced at about a 90° degree angle from an adjacent retention mechanism 80. The pair of retention mechanisms 80 may be configured to retain one of the shaped charges 120 within one shaped charge receptacle 30. The retention mechanisms 80 may each include an elongated shaft 81, and a hook 83 that extends outwardly from the elongated shaft. The hook 83 is at least partially curved to engage with a cylindrical wall of the shaped charges 120, thereby helping to secure the shaped charge 120 within its corresponding shaped charge receptacle 30, and thus the shaped charge holder 20.

According to an aspect, the depression 32 of the shaped charge receptacles 30, in combination with at least one of the retention mechanisms 80 and the shaped charge positioning blocks 85, aid in mechanically securing at least one of the shaped charges 120 within the positioning device 10.

An elongated cavity/lumen 40 extends through the positioning device 10, from the first end 22 to the second end 24. The elongated cavity 40 may be centrally located within the positioning device 10 and is adjacent each of the shaped charge receptacles 30, and thereby the shaped charge 120 housed in the receptacles 30.

Figure 6:
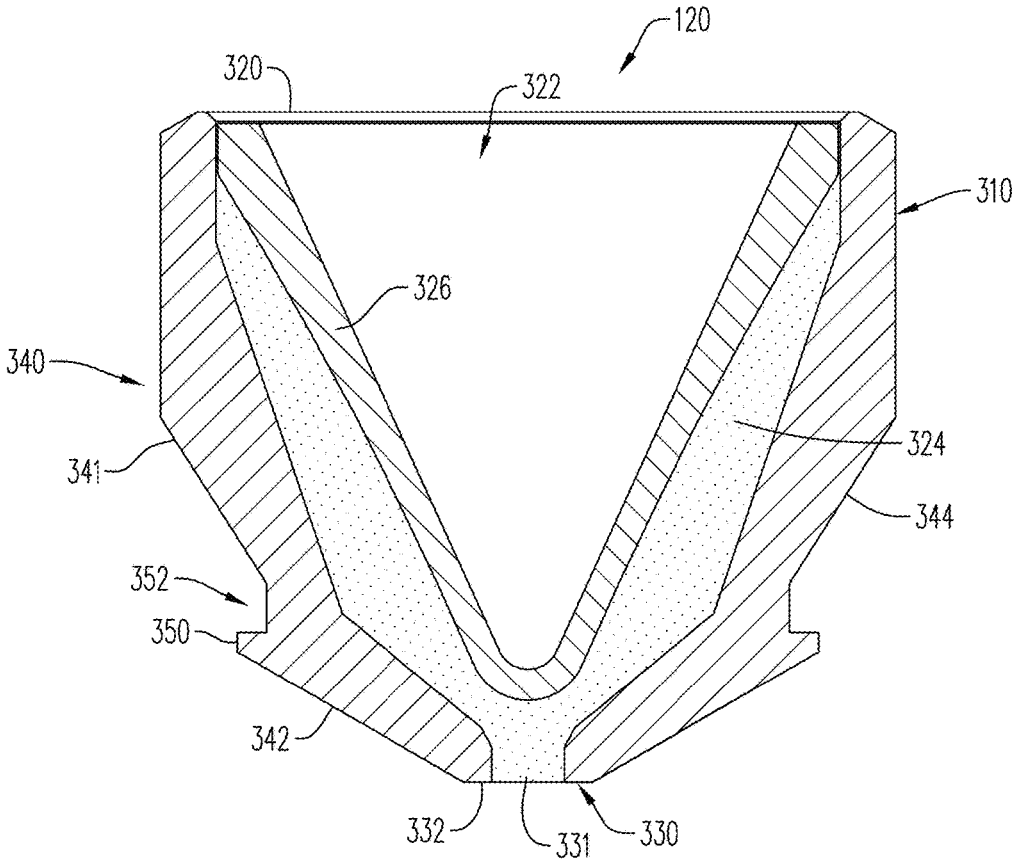
FIG. 6 is a partial, cross-sectional view of a shaped charge for use with a positioning device, according to an aspect.
Figure 11:
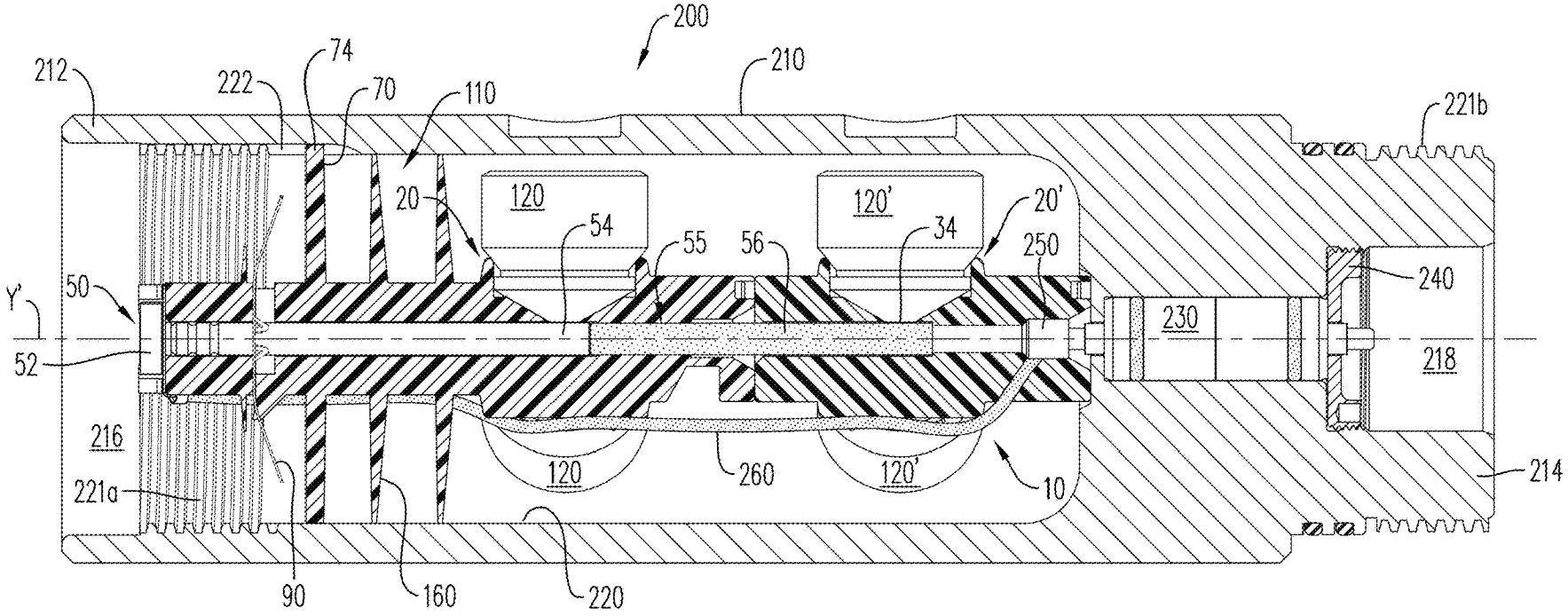
FIG. 11 is a partial cross-sectional, side view of a perforating gun module including a positioning device and a detonator positioned in the first positioning device and an adjacent positioning device including a detonation extender, according to an embodiment.

The elongated cavity 40 may be configured for receiving and retaining a detonative device therein. According to an aspect, the detonative device includes a detonator 50 (FIG. 11). The detonator 50 may be positioned centrally within the shaped charge holder 20. According to an aspect and as illustrated in FIG. 6, the plurality of shaped charges 120 housed in the shaped charge holder 20 includes an open front end 320 and a back wall 330 having an initiation point 331 extending therethrough. The detonator 50 is substantially adjacent the initiation point 331 and is configured to simultaneously initiate the shaped charges 120 in response to an initiation signal, such as a digital code.

According to an aspect, the detonator 50 is a wireless push-in detonator. Such detonators are described in U.S. Pat. Nos. 9,605,937 and 9,581,422, both commonly owned and assigned to DynaEnergetics GmbH & Co KG, each of which is incorporated herein by reference in its entirety. According to an aspect, the detonator 50 includes a detonator head 52 and a detonator body 54 (FIG. 11) extending from the detonator head 52. The detonator head 52 includes an electrically contactable line-in portion, an electrically contactable line-out portion, and an insulator positioned between the line-in and line-out portions, wherein the insulator electrically isolates the line-in portion from the line-out portion. The detonator body 54 may be energetically coupled to or may energetically communicate with each of the shaped charges 120. According to an aspect, the detonator body 54 may include a metal surface, that provides a contact area for electrically grounding the detonator 50.

Figure 9:
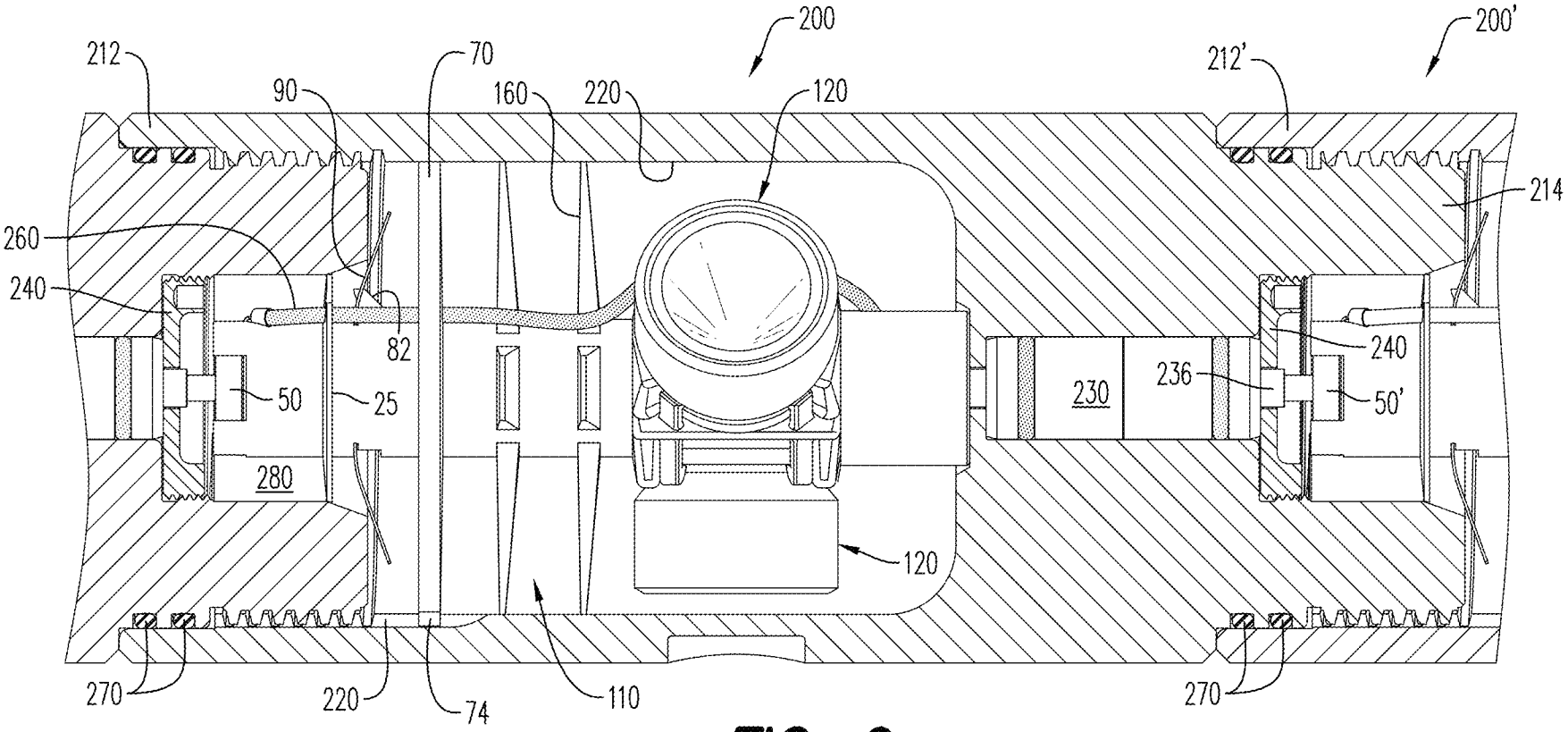
FIG. 9 is a partial cross-sectional, side view of the perforating gun module of FIG. 8, illustrating a through wire extending from a detonator to a bulkhead assembly.

The positioning device 10 may include passageways 28 that help to guide a feed through/electrical wire 260 (FIG. 9) from the detonator 50 to contact a bulkhead assembly/pressure bulkhead assembly 230 (FIG. 9). As illustrated in FIGS. 1-2 and FIG. 11, the passageway 28 may be formed at the second end 24 of the positioning device 10 and receives and guides the feed through wire/electrical wire 260 to the bulkhead assembly 230.

Figure 4:
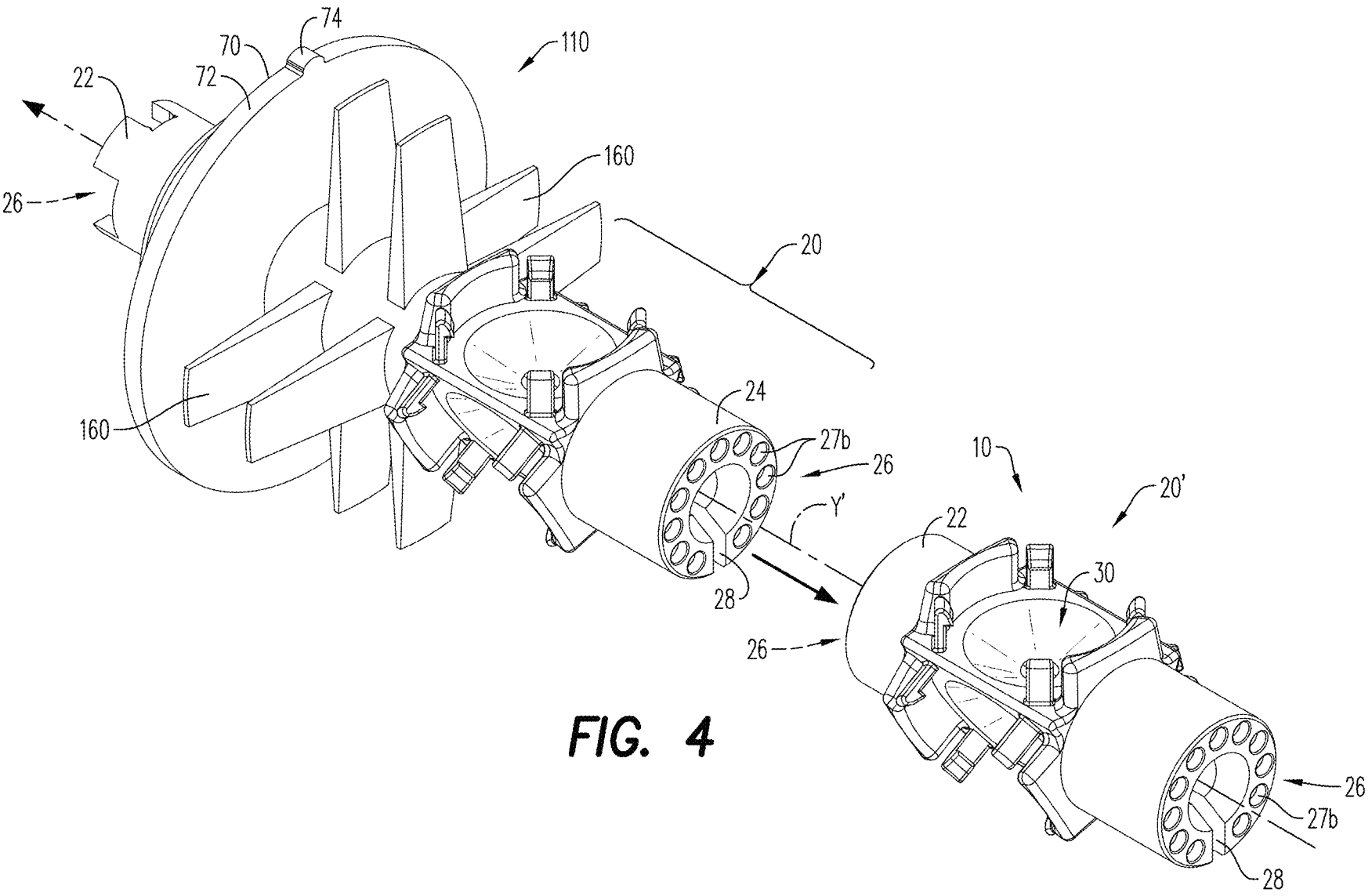
FIG. 4 is side, perspective view of the positioning device of FIG. 3 for being attached to the positioning device of FIG. 1.

The positioning device 10 may be configured as a modular device having a plurality of connectors 26 that allows the positioning device 10 to connect to other adjacent positioning devices, adjacent shaped charge holders, and spacers, as illustrated in FIG. 4. The positioning device 10 may be configured to engage or connect to charge holders, spacers and connectors described in U.S. Pat. Nos. 9,494,021 and 9,702,680, both commonly owned and assigned to DynaEnergetics GmbH & Co KG, each of which is incorporated herein by reference in its entirety.

The connectors 26 each extend along the central Y-axis of the shaped charge holder 20. According to an aspect, the connectors 26 includes at least one of a plurality of plug connectors/pins **27*a* and a plurality of receiving cavities/sockets 27*b*. The plurality of receiving cavities/sockets 27*b* are shown in FIG. 1 and FIG. 2 on the opposite end of the positioning device 10, for receiving plug connectors 27*a* from a downstream positioning device. The plug connectors 27*a* outwardly extend from the first or second end 22, 24, and the receiving cavities 27***b* inwardly extend into the positioning device 10 from the first or second end 22, 24. The plug connectors 27*a* are configured for being inserted and at least temporarily retained into the receiving cavities 27*b* of the adjacent positioning device, shaped charge holder, spacer or other connectors, while the receiving cavities 27*b* are configured to receive plug connectors 27*a* of another adjacent positioning device, charge holder, spacer or other components. When the first end 22 includes plug connectors 27*a*, the second end 24 includes receiving cavities 27*b* that are configured to receive and retain the plug connectors of the adjacent positioning device, charge holder, spacer or other components. According to an aspect, the plug connectors 27*a* are mushroom-shaped, which may aid in the retention of the plug connectors 27*a* in the receiving cavities.

Further embodiments of the disclosure are associated with a positioning device 110, as illustrated in FIGS. 3-5 and 8-11. The positioning device 110 includes a first end 22 and a second end 24. According to an aspect, the first end 22 of the positioning device 110 may be contoured to retain a detonator head 52 (FIG. 8 and FIG. 12B) therein. A shaped charge holder 20 extends between the first and second ends 22, 24 of the positioning device 110. For purposes of convenience, and not limitation, the general characteristics of the shaped charge holder 20 applicable to the positioning device 110, are described above with respect to the FIGS. 1-2, and are not repeated here.

Figure 3:
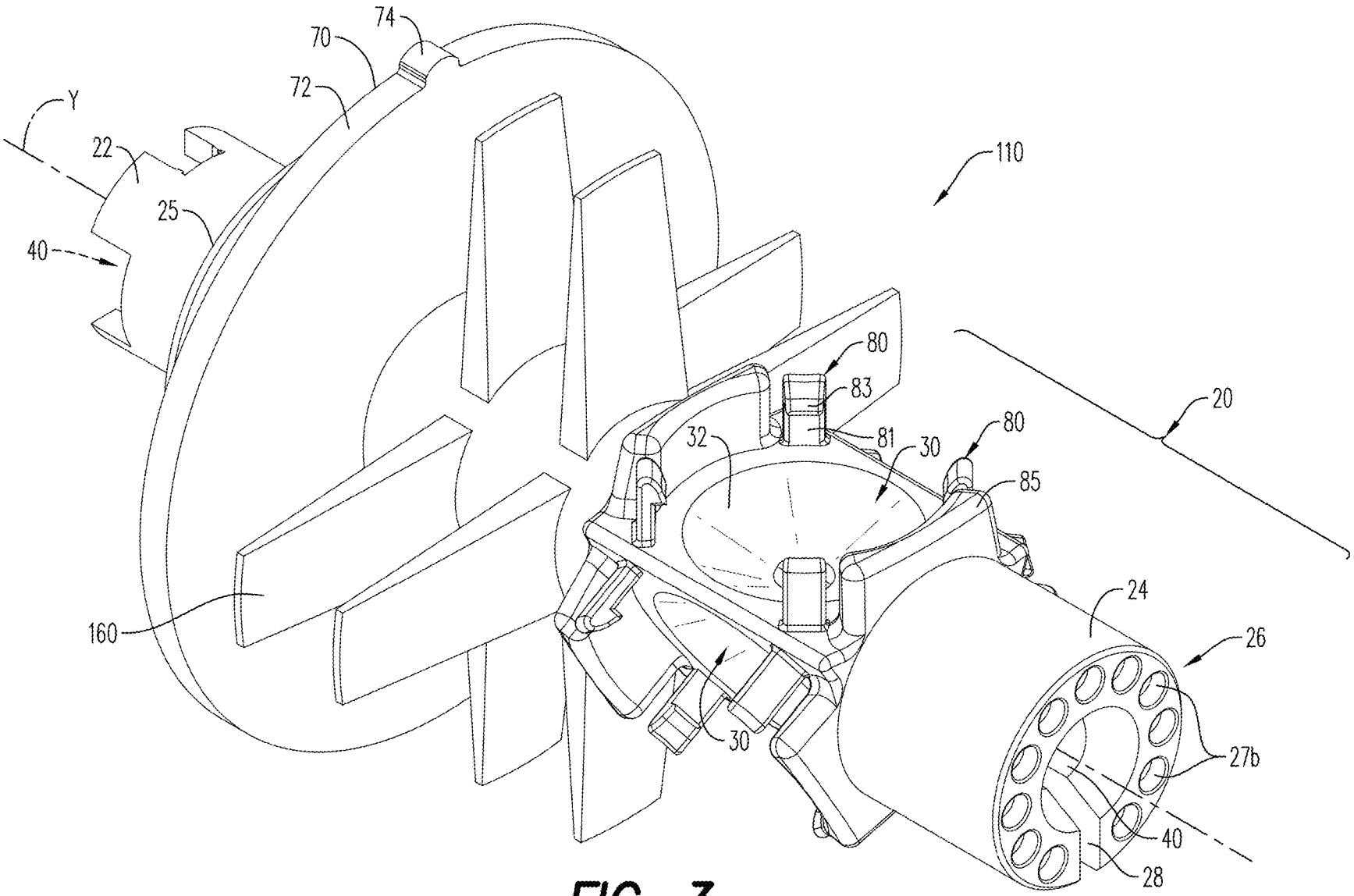
FIG. 3 is a side, perspective view of a positioning device including a plurality of ribs and a plate, according to an embodiment.

Similar to the shaped charge holder described hereinabove with reference to FIGS. 1-2, the shaped charge holder 20 illustrated in FIG. 3 includes a plurality of shaped charge receptacles 30, a plurality of retention mechanisms 80 and a plurality of positioning blocks 85, which are configured substantially as described hereinabove with respect to FIGS. 1-2. Thus, for purpose of convenience, and not limitation, the features and characteristics of the receptacles 30, the retention mechanisms 80 and the positioning blocks 85 of the positioning block 110 are not repeated here.

The positioning device 110 further includes an elongated cavity/lumen 40 extending through a length of the positioning device 110. The elongated cavity 40 extends from the first end 22 to the second end 24, adjacent each of the shaped charge receptacles 30, and is configured for receiving and retaining a detonator 50.

Figure 10:
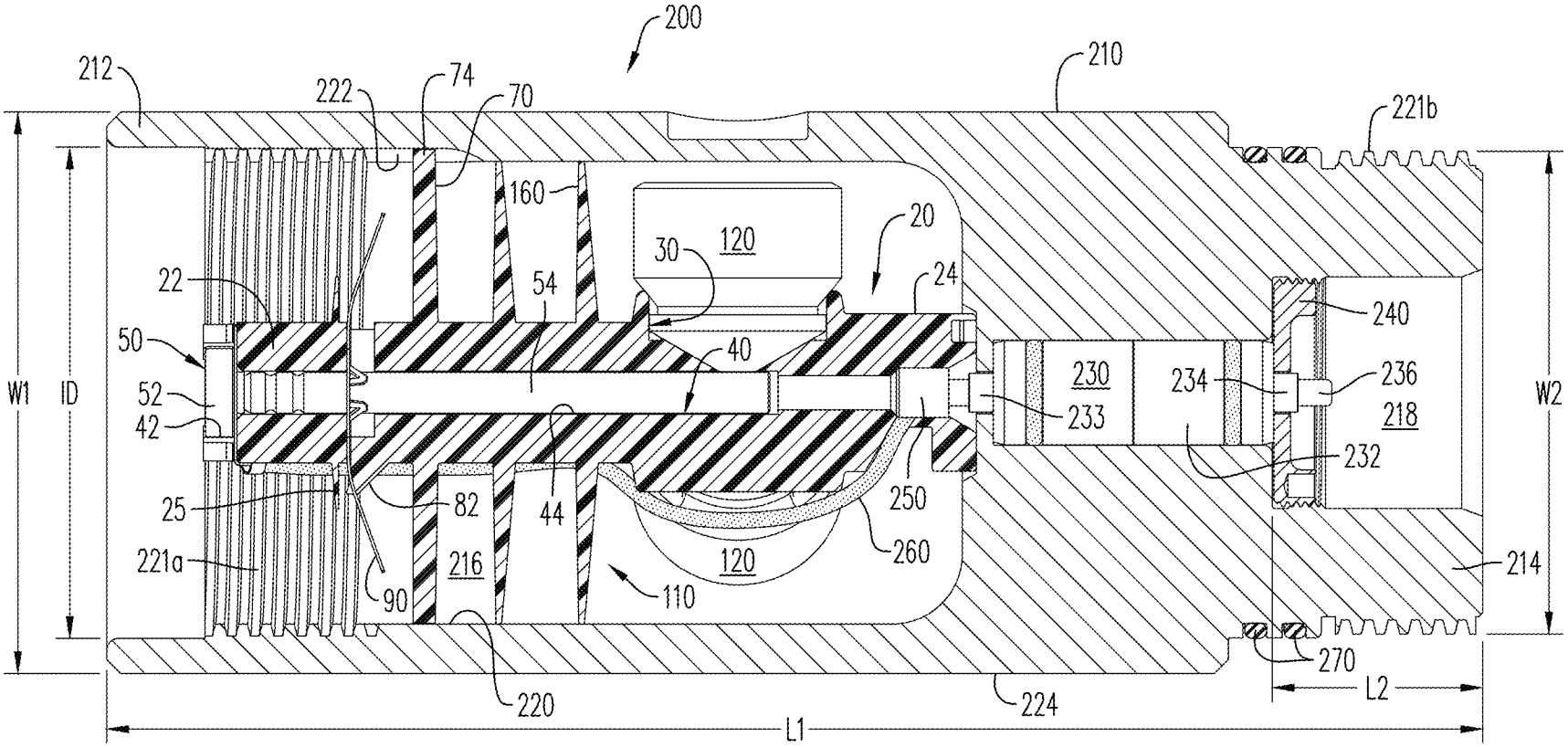
FIG. 10 is a partial cross-sectional, side view of a perforating gun module including a positioning device and a detonator positioned therein, according to an embodiment.

FIG. 10 illustrates the detonator 50 positioned in the elongated cavity 40. The detonator 50 is configured to initiate the shaped charges 120 simultaneously in response to an initiation signal. As described hereinabove, the detonator 50 may be a wireless push-in detonator. The detonator 50 of the positioning device 110 may be configured substantially as the detonator 50 of the positioning device 10 described hereinabove with respect to FIGS. 1-2, thus for purposes of convenience and not limitation, the various features of the detonator 50 for the positioning device 10 are not repeated hereinbelow.

The detonator 50 of the positioning device 110 includes a detonator head 52 and a detonator body 54 is energetically coupled to each of the shaped charges 120. The elongated cavity 40 may be stepped or contoured to receive the head 52 and body 54 of the detonator 50. According to an aspect and as illustrated in FIG. 10, the elongated cavity 40 includes a first cavity 42 and a second cavity 44 extending from the first cavity 42. The first cavity 42 extends from and is adjacent the first end 22 of the positioning device 110, while the second cavity 44 extends from the first cavity 42 towards the second end 24. The first cavity 42 is larger than the second cavity 44 and is configured for receiving the detonator head 52, while the second cavity 44 is configured for receiving the detonator body 54.

According to an aspect, the positioning device 110 may be equipped with means for maintaining the positioning device in a preselected position in a perforating gun module 200. The positioning device 110 may include at least one rib/fin 160 outwardly extending from the positioning device 110. FIG. 3 illustrates ribs 160 radially extending from the positioning device 110 and being arranged between the first end 22 of the positioning device 110 and the shaped charge holder 20. The ribs 160 may be substantially equal in length with each other and may be configured to engage with an interior surface of a perforating gun module 200, as illustrated in, for example, FIGS. 8-11.

The positioning device 110 may further include a plate 70 at least partially extending around the positioning device 110. The plate 70 may be disposed/arranged between the first end 22 and the rib 160. FIG. 3 illustrates a protrusion/anti-rotation key 74 extending from a peripheral edge 72 of the plate 70. The protrusion 74 may be configured to secure the positioning device 110 within a perforating gun module 200, and to prevent rotation of the positioning device 110 and the shaped charge holder 20 within the perforating gun module 200. As illustrated in FIGS. 8-11 and FIG. 12B, the protrusion 74 may be configured to engage with an inner surface 220 (or a slot 222) of a housing 210 of the perforating gun module 200, which helps ensure that the shaped charges 120 are maintained in their respective positions with respect to the perforating gun module 200. According to an aspect, the plate 70 is sized and dimensioned to capture debris resulting from detonation of the plurality of shaped charges 120. As illustrated in FIG. 3, the plate 70 has a larger surface area than the ribs 160, such that it is able to collapse with at least one of the shaped charge holder 20 and the ribs 160, and capture any debris generated by the detonation of the shaped charges 120, thereby reducing the amount (i.e., number of individual debris) that may need to be retrieved from the wellbore.

Figure 8:
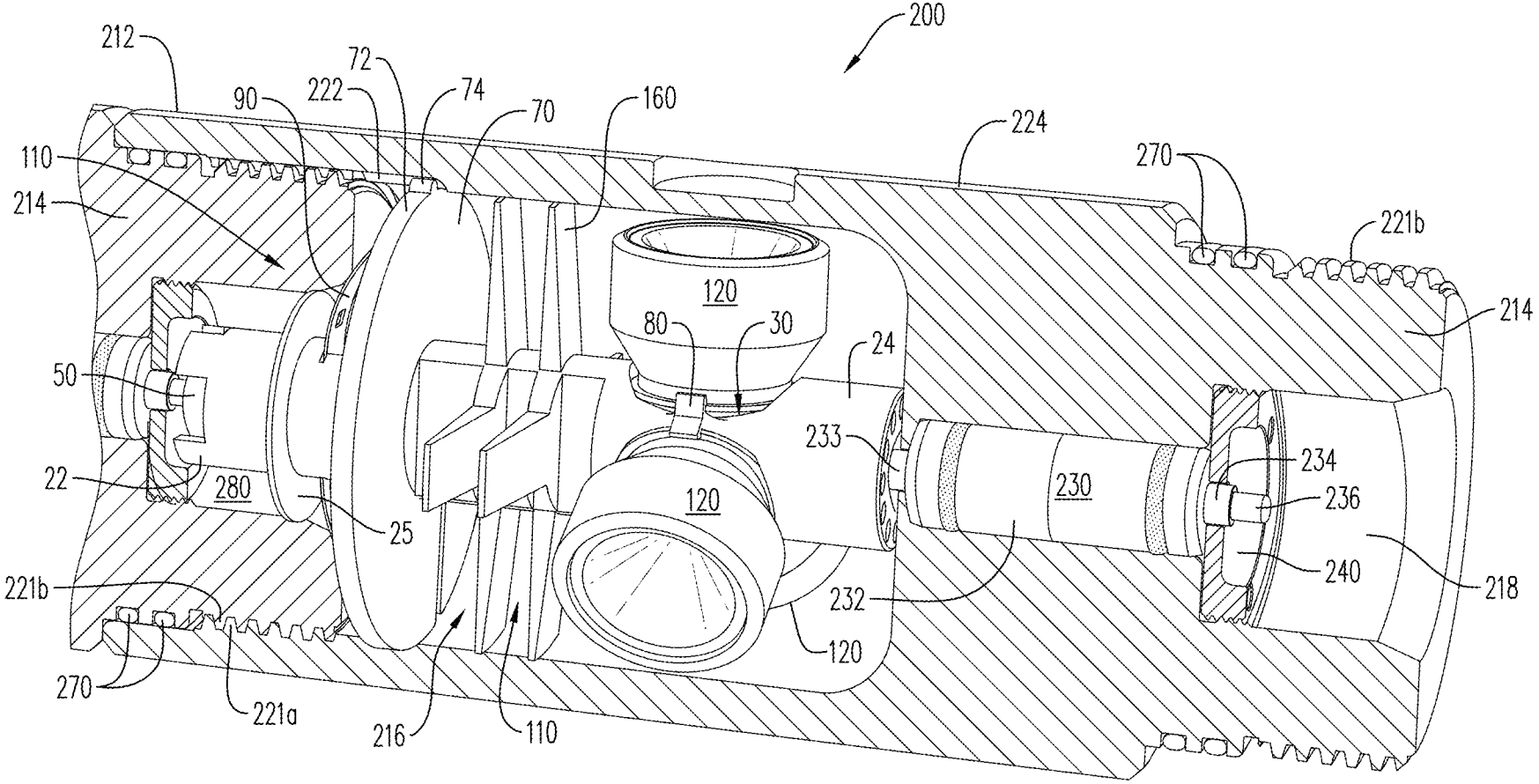
FIG. 8 is a partial cross-sectional and perspective view of a perforating gun module, illustrating a positioning device therein, according to an aspect.

The positioning device 110 further includes a disk 25 outwardly and circumferentially extending from the positioning device 110. The disk is arranged between the first end 22 and the plate 70 and, as illustrated in FIG. 8 and FIG. 9, may help to create an isolation chamber 280 for the detonator head 52. The isolation chamber 280 may protect and isolate the detonator 50 from lose metallic particles, shards, machine metal shavings and dust, or substantially minimize the detonator head 52 from such exposure, that may negatively impact the functionality of the detonator 50 and cause an electrical short circuit in the system.

According to an aspect, one or more components of the positioning device 110 may be configured with a passageway 28. The passageway 28 may formed in at least one of the disk 25 (FIG. 12B), the plate 70 (FIG. 12B) and the second end 24 (FIG. 304) of the body 20. The passageway 28 receives and guides a feed through wire/electrical wire 260 from the detonator 50 to the second end of the positioning device 110, wherein the wire 260 contacts a bulkhead assembly/rotatable bulkhead assembly 230.

Figure 14:
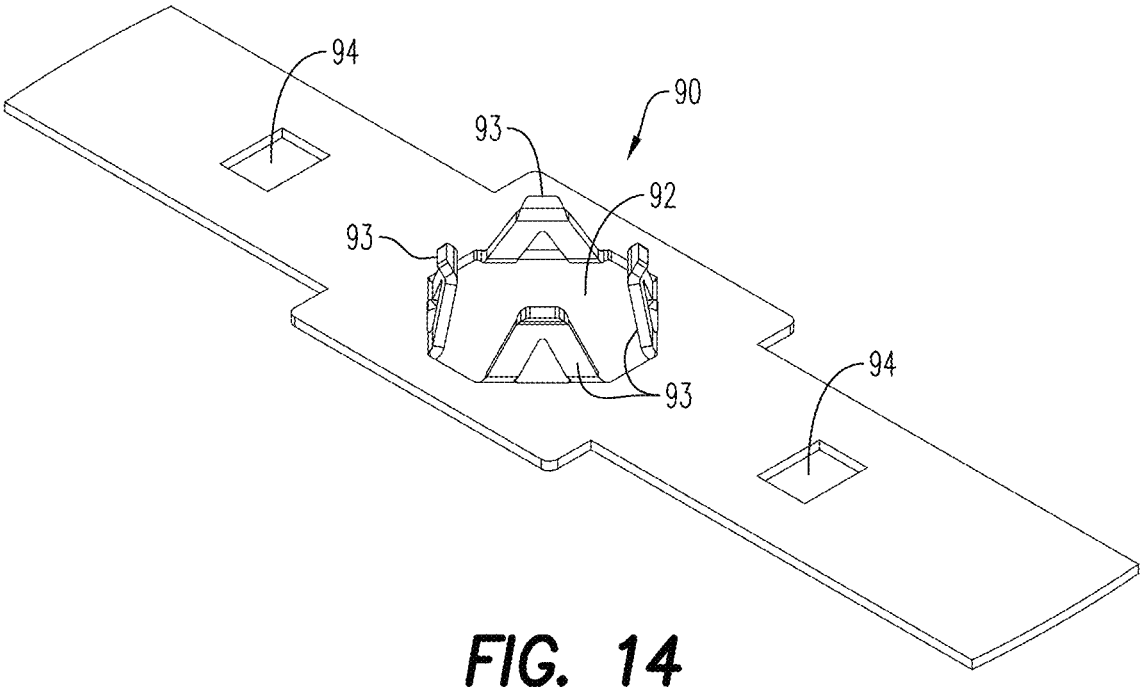
FIG. 14 is a perspective view of a ground bar couplable to a positioning device, according to an embodiment.

As illustrated in FIGS. 8-11 and FIG. 12B, a ground bar 90 may be arranged on or otherwise coupled to the positioning device 110. The ground bar 90 is secured to the positioning device 110, between the first end 22 and the plate 70. According to an aspect, a support member 82 extends from the positioning device 110, between the ground bar 90 and the plate 70. The support member 82 is configured to prevent movement of the ground bar 90 along the central Y-axis of the shaped charge holder 20, to ensure that the ground bar 90 is able to contact a portion of an adjacent perforating gun module. FIG. 14 shows the ground bar 90 in more detail. The ground bar 90 may include a centrally-arranged opening 92 having a plurality of engagement mechanisms 93, and one of more slots 94 to facilitate the ground bar 90 being secured to the positioning device 110 and to facilitate the engagement of the ground bar 90 with the adjacent perforating gun module. According to an aspect, the ground bar 90 is formed from a stamped, laser cut, or water-jet cut sheet of metal. The ground bar 90 may be formed from at least one of stainless steel, brass, copper, aluminum or any other electrically conductive sheeted material which can be stamped and re-worked, water jet cut or laser cut.

Figure 17:
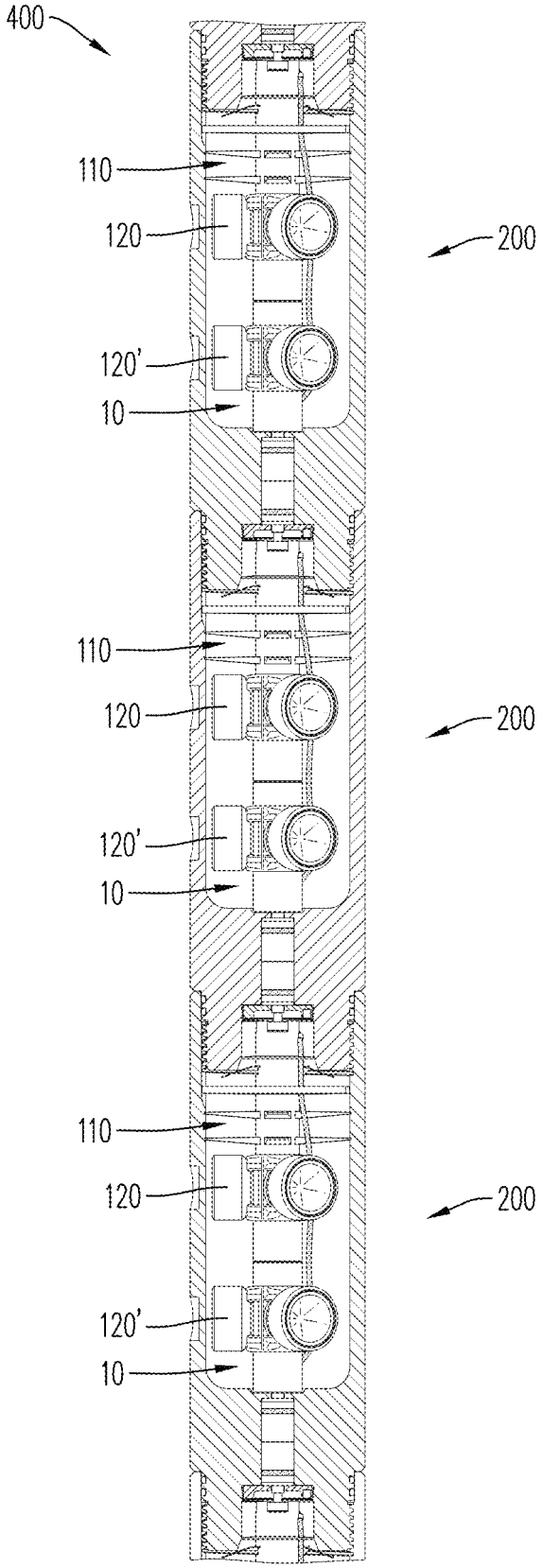
FIG. 17 is a side, partial cross-sectional and perspective view of the string of the perforating gun modules configured according to FIG. 11.

According to an aspect, and as illustrated in at least FIGS. 4, 11, and 17, the positioning device 110 may be connectable to adjacent devices or components of a perforating gun module 200. In an embodiment, at least one of the first end 22 and the second end 24 includes a plurality of connectors 26 extending along the central Y-axis of the charge holder 20. The connectors 26 provide for a modular connection between the positioning device 110 and at least one of an adjacent positioning device, an adjacent shaped charge holder and a spacer including corresponding connectors. The connectors 26 of the positioning device 110 may be configured substantially as the connectors 26 of the positioning device 10 described hereinabove with respect to FIGS. 1-2, thus for purposes of convenience and not limitation, the various features of the connectors 26 of the positioning device 10 are not repeated here.

In an embodiment and as shown in FIG. 11, the shaped charges 120 is a first set of shaped charges, and a second set of shaped charges 120' is supported in a separate shaped charge holder 20' connected to the positioning device 110. The separate shaped charge holder 20' may be included in the positioning device 10 illustrated in FIGS. 1-2. The separate shaped charge holder 20' includes a plurality of shaped charge receptacles 30 extending between first and second ends 22, 24 of the separate shaped charge holder 20'. The receptacles 30 are radially arranged in an XZ-plane about a central Y-axis of the separate shaped charge holder 20', each receptacle 30 retaining one of the shaped charges 120'.

Figure 13A:
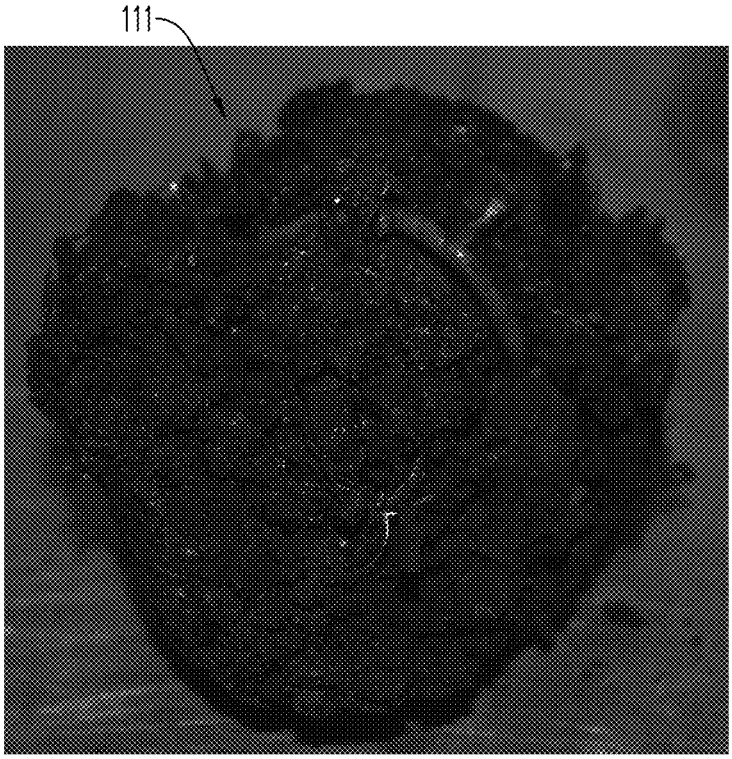
FIG. 13A is a perspective view of a resulting mass formed from the detonation of shaped charges positioned in a positioning device, according to an aspect.

An elongated cavity 40 extends from the first end 22 to the second end 24 of the separate shaped charge holder 20' and is configured for retaining a detonation extender 55 therein. According to an aspect, the detonation extender 55 includes a detonating cord or a booster device 56. As illustrated in FIG. 11, when the positioning device 110 is connected to the separate shaped charge holder 20', the detonation extender 55 is configured to abut an end of the detonator body 54 and extend from the elongated opening 40 of the positioning device 110 into the elongated opening 40 of the separate shaped charge holder 20' so the detonator extender is adjacent initiation points 331 of the separate shaped charges 120'. The detonation extender 55 is adjacent a plurality of openings 34 formed in the shaped charge receptacles of the separate shaped charge holder 20'. When the detonator 50 is activate, a detonation energy from the detonator 50 simultaneously activates the shaped charges 120 of the first set of shaped charges and the detonation extender 55. The detonation extender 55 thereafter generates a detonation wave, which simultaneously activates the second set of shaped charges 120'. Once all the charges 120, 120' have detonated, the positioning device 110 and the separate charge holder 20' forms a resulting mass 111 (FIGS. 13A-13B) and limits the amount of debris generated upon detonation of the shaped charges.

According to an aspect, the shaped charges 120 for use with the aforementioned positioning devices 10/110 illustrated in FIGS. 1-5 may be specially configured to be secured in a shaped charge holder 20/20' (collectively shaped charge holder 20) described hereinabove. According to an aspect and as illustrated in FIG. 6, a shaped charge 120 for use at least one of a positioning device 110 and a shaped charge holder 20) includes a substantially cylindrical/conical case 310. The conical case 310 includes an open front end 320, a back wall 330 having an initiation point 331 extending therethrough, and at least one cylindrical side wall 340 extending between the open front end 320 and the back wall 330.

The shaped charge 120 further includes a cavity 322 defined by the side wall 340 and the back wall 330. An explosive load 324 is disposed within the cavity 322. According to an aspect, the explosive load 324 includes at least one of pentaerythritol tetranitrate (PETN), cyclotrimethylenetrinitramine (RDX), octahydro-1,3,5,7-tetranitro-1,3,5,7-tetrazocine/cyclotetramethylene-tetranitramine (HMX), 2,6-Bis(picrylamino)-3,5-dinitropyridine/picrylaminodinitropyridin (PYX), hexanitrostibane (HNS), triaminotrinitrobenzol (TATB), and PTB (mixture of PYX and TATB). According to an aspect, the explosive load 324 includes diamino-3,5-dinitropyrazine-1-oxide (LLM-105). The explosive load may include a mixture of PYX and triaminotrinitrobenzol (TATB). The type of explosive material used may be based at least in part on the operational conditions in the wellbore and the temperature downhole to which the explosive may be exposed.

As illustrated in FIG. 6, a liner 326 is disposed adjacent the explosive load 324. The liner 326 is configured for retaining the explosive load 324 within the cavity 322. In the exemplary embodiment shown in FIG. 6, the liner 326 has a conical configuration, however, it is contemplated that the liner 326 may be of any known configuration consistent with this disclosure. The liner 326 may be made of a material selected based on the target to be penetrated and may include, for example and without limitation, a plurality of powdered metals or metal alloys that are compressed to form the desired liner shape. Exemplary powdered metals and/or metal alloys include copper, tungsten, lead, nickel, bronze, molybdenum, titanium and combinations thereof. In some embodiments, the liner 326 is made of a formed solid metal sheet, rather than compressed powdered metal and/or metal alloys. In another embodiment, the liner 326 is made of a non-metal material, such as glass, cement, high-density composite or plastic. Typical liner constituents and formation techniques are further described in commonly-owned U.S. Pat. No. 9,862,027, which is incorporated by reference herein in its entirety to the extent that it is consistent with this disclosure. When the shaped charge 120 is initiated, the explosive load 324 detonates and creates a detonation wave that causes the liner 326 to collapse and be expelled from the shaped charge 120. The expelled liner 326 produces a forward-moving perforating jet that moves at a high velocity According to an aspect, the cylindrical side wall portion 340 includes a first wall 342 outwardly extending from a flat surface 332 of the back wall 330, a second wall 344 outwardly extending from the first wall 342, and a third wall 346 upwardly extending from the second wall 344 towards the open front end 320. The third wall 346 may be uniform in width as it extends from the second wall 344 to the open from end 320.

An engagement member 350 outwardly extends from an external surface 341 of the side wall 340. As illustrated in FIG. 6, the engagement member 350 extends from the first wall 342, at a position adjacent the second wall 344. As illustrated in FIG. 5, the engagement member 350 may be configured for coupling the shaped charge 120 within a shaped charge holder 20 of a positioning device 10/110. In an embodiment, at least one of the first wall 342 and the second wall 344 includes a groove/depression 352 circumferentially extending around the side wall 340. The groove 352 extends inwardly from the side wall 340 of the case 310 towards the cavity 322. The groove (352 may be configured to receive one or more retention mechanisms 80 of the positioning device 10/110 or the shaped charge holder 20, thereby securedly fastening the shaped charge 120 to the positioning device 10/110 or the shaped charge holder 20.

According to an aspect, the size of the shaped charge 120 may be of any size based on the needs of the application in which the shaped charge 120 is to be utilized. For example, the conical case 310 of the shaped charge 120 may be sized to receive from about 3 g to about 61 g of the explosive load 324. As would be understood by one of ordinary skill in the art, the caliber/diameter of the liner 326 may be dimensioned based on the size of the conical case 310 and the explosive load 324 upon which the liner 326 will be disposed. Thus, even with the use of three (3) shaped charges in the positioning device 10/110 (i.e., a three-shot assembly), the arrangement of the shaped charges 120 in the positioning device 10/110, in combination with adjusting the size of the shaped charges 120, may provide the equivalent shot performance (and provide equivalent fluid flow) of a typical assembly/shot carrier having 4, 5, 6 shaped charges.

Embodiments of the disclosure are further associated with a perforating gun module 200. The perforating gun module 200 includes a housing/sub assembly/one-part sub 210 formed from a preforged metal blank/shape. The housing 210 may include a length L1 of less than about 12 inches, alternatively less than about 9 inches, alternatively less than about 8 inches. According to an aspect, the length of the housing 210 may be reduced because the perforating gun module 200 does not require the use of separate tandem sub adapters to connect or seal a plurality of perforating gun modules 200.

The housing 210 includes a first housing end 212, a second housing end 214, and a chamber 216 extending from the first housing end 212 towards the second housing end 214. The housing 210 may be configured with threads to facilitate the connection of a string of perforating gun modules 200 together. According to an aspect, an inner surface 220 of the housing 210 at the first housing end 212 includes a plurality of internal threads 221*a*, while an outer/external surface 224 of the housing 210 includes a plurality of external threads 221*b* at the second housing end 214. A plurality of housings 210 may be rotatably connected to each other via the threads 221, 221*b*. A plurality of sealing mechanisms, such as o-rings 270, may be used to seal the housing 210 of the perforating gun 200 from the contents of the housing of an adjacent perforating gun, as well as from the outside environment (fluid in the wellbore) from entering the chamber 216.

As illustrated in FIG. 10, the first housing end 212 has a first width W1, the second housing end 214 has a second width W2, and the chamber 216 has an internal diameter ID. The second width W2 may be less than the first width W1, and the internal diameter ID of the chamber 216 may be substantially the same as the second width W2. As illustrated in FIG. 9, for example, the second housing end 214 of the housing 210 of the perforating gun 200 may be rotatably secured within the first housing end 212 (i.e., in the chamber) of the housing of an adjacent perforating gun 200'. According to an aspect, the second housing end 214 is configured to be secured within a chamber of an adjacent perforating gun assembly 200', and the first housing end 212 is configured to secure a second housing end of another adjacent perforating gun module.

According to an aspect, one or more positioning devices 10/110 may be secured in the chamber 216 of the housing 210. The positioning device 10/110 may be configured substantially as described hereinabove and illustrated in FIGS. 1-5. Thus, for purposes of convenience, and not limitation, the features and functionality of the positioning device 10/110 are not repeated in detail herein below.

As illustrated in FIGS. 8-10 and according to an aspect, the first end 22 of the positioning device 110 is adjacent the first housing end 212. The rib 160 of the device 110 engages with an inner surface 220 of the housing 210, within the chamber 216, thereby preventing the device from moving upwardly or downwardly in the chamber 216.

Figure 7:
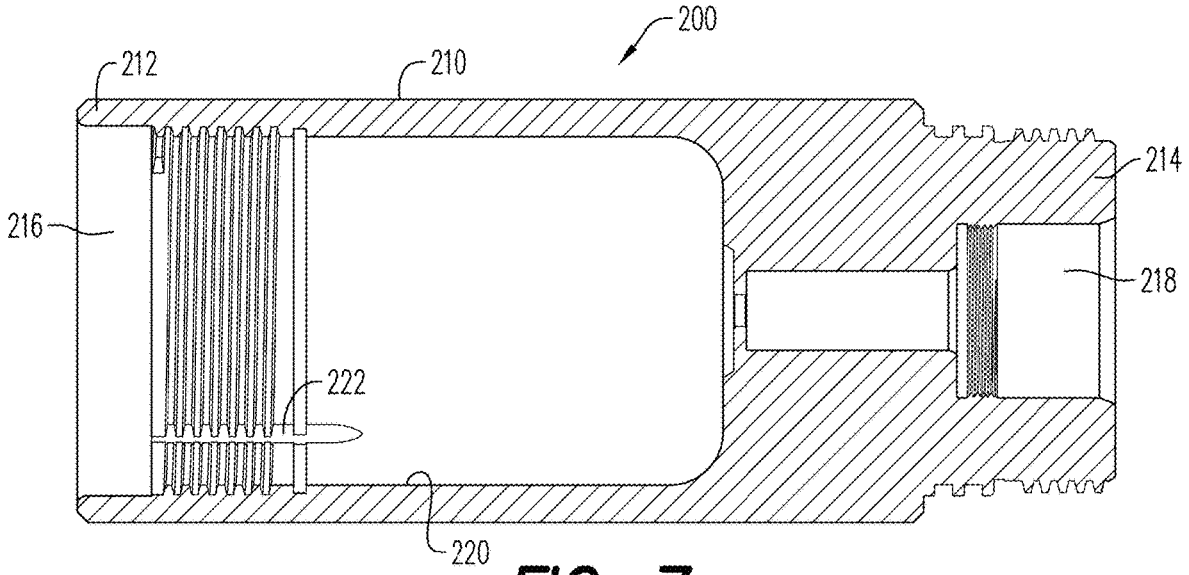
FIG. 7 is a cross-sectional view of a housing of a perforating gun module, according to an aspect.
Figure 12A:
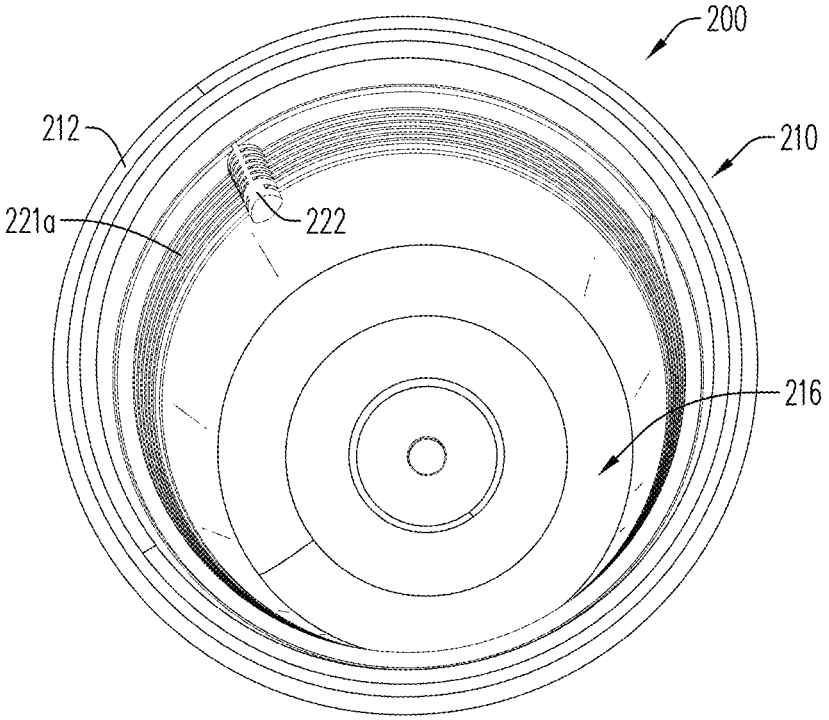
FIG. 12A is a top down view of a housing of a perforating gun module, according to an embodiment.
Figure 12B:
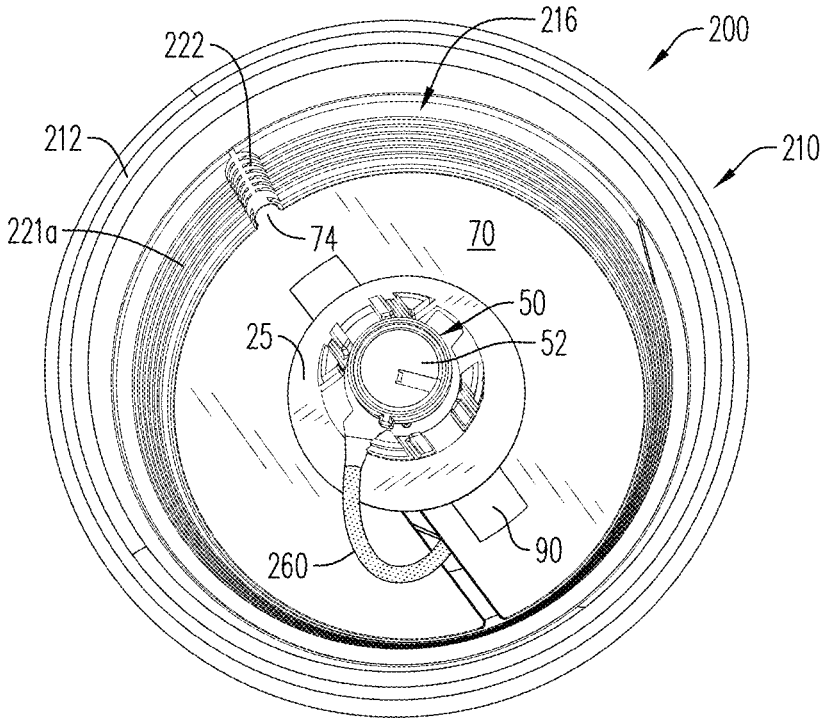
FIG. 12B is a top down view of the perforating gun module of FIG. 12A, illustrating a positioning device therein.
Figure 13B:
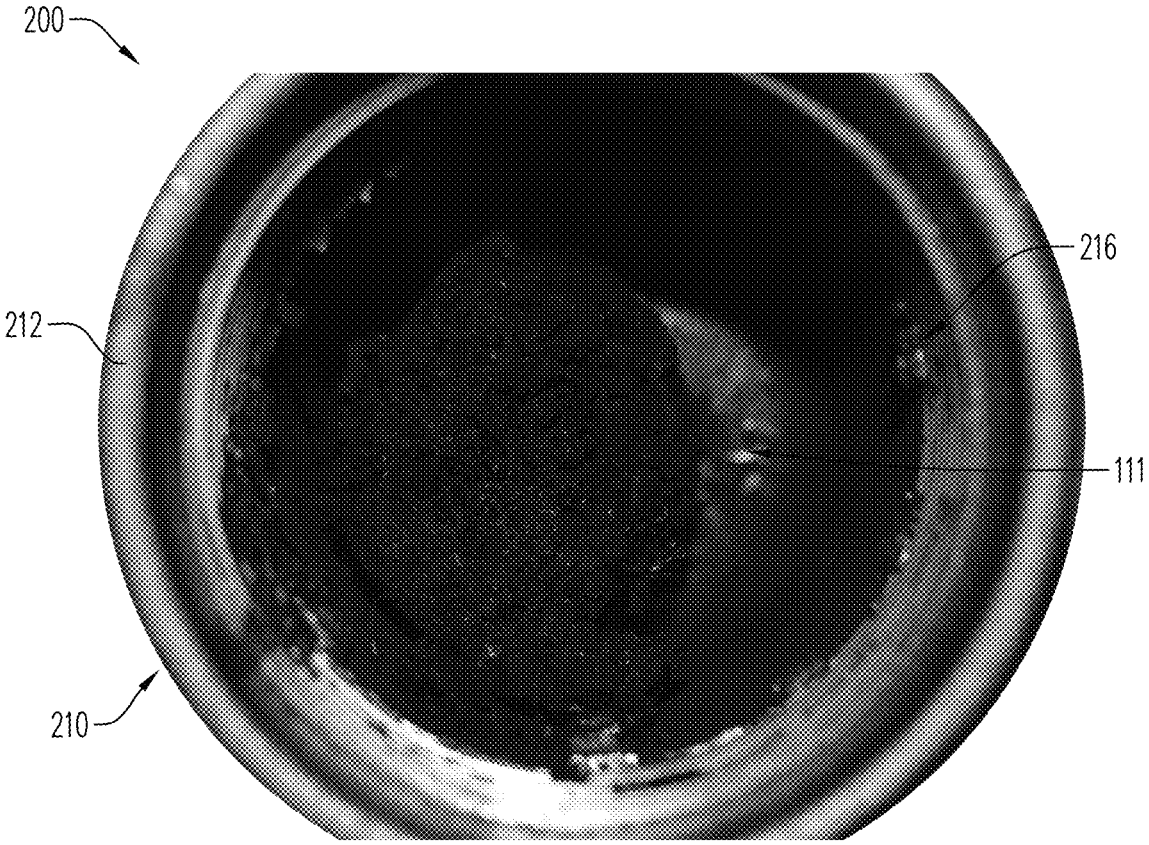
FIG. 13B is a top down view of the perforating gun module of FIG. 12B, illustrating a resulting mass formed upon detonation of the shaped charges positioned in the positioning device.

As illustrated in FIGS. 8-11, a plate 70 of the positioning device 110 helps to further secure the positioning device 110 in the housing 210. The plate 70 includes a protrusion 74 extending from a peripheral edge 72 of the plate 70. As illustrated in FIGS. 12A-12B, the protrusion 74 may be seated in a slot 222 formed in an inner surface 220 of the housing 210. FIG. 7 illustrates the slot extending from the first housing end 212 into the chamber 216. The protrusion 74 of the plate 70 engages the slot 222 to secure the positioning device 110 within the perforating gun 200 and prevent unwanted rotation of the positioning device 110, and thus the shaped charge holder 20, within the perforating gun module 200. As described hereinabove, upon detonation of the shaped charges 120, the plate 70 and the shaped charge holder 20 is configured to capture debris resulting from detonation of the shaped charges 120. The captured debris, the plate 70 and the shaped charge holder 20 forms a mass/resulting mass 111 (FIG. 13A) upon the detonation of the charges 120. As seen in FIG. 13B, the resulting mass 111 is retained in the chamber 216 of the housing 210. The resulting mass 111 includes shrapnel and debris created upon the detonation of the shaped charges, as well as any additional wires (e.g. through wire 260) or components previously placed or housed in the housing 210.

The housing 210 further includes a recess/mortise 218 extending from the second housing end 214 towards the chamber 216. The recess 218 partially tapers from the second housing end 214 towards the chamber 216 and is configured to house the detonator head 52 of a detonator 50 of an adjacent positioning device 110. As illustrated in FIG. 9, for example, the disk 25 of the positioning device 110 of an adjacent perforating gun 200 covers a portion of the recess 218, thereby forming an isolation chamber 280 for the detonator head 52. According to an aspect, when the housing 210 includes a length L1 of less than about 8 inches, the recess 218 may include a length L2 of less than about 2 inches.

A bulkhead assembly 230 may be positioned between the chamber 216 (i.e., adjacent the second end 24 of the positioning device 110) and the recess 218. According to an aspect, the bulkhead assembly 230 is a rotatable bulkhead assembly. Such bulkhead assemblies are described in U.S. Pat. No. 9,784,549, commonly owned and assigned to DynaEnergetics GmbH & Co KG, which is incorporated herein by reference in its entirety.

The bulkhead assembly includes a bulkhead body 232 having a first end 233 and a second end 234. A metal contact plug/metal contact 250 is adjacent the first end 233 of the bulkhead body 232 and a downhole facing pin 236 extends from a second end 234 of the bulkhead body 232. The perforating gun module 200 further includes a feed through wire 260 extending from the detonator 50 to the metal contact plug 250 via the line-out portion of the detonator head 52. The metal contact plug 250 is configured to secure the feed through wire 260 to the first end 233 of the bulkhead assembly 230. According to an aspect, the metal contact plug 250 provides electrical contact to the bulkhead assembly 230, while the downhole facing pin 236 is configured to transfer an electrical signal from the bulkhead assembly 230 to a detonator 50' of the adjacent perforating gun module 200'.

FIGS. 8-11 illustrate a collar 240 secured within the recess 218. The collar 240 is adjacent the second end 234 of the bulkhead assembly 230. According to an aspect, the collar 240 includes external threads 242 (FIG. 10) configured for engaging with or being rotatably secured in the recess 218 of the housing 210. When the collar 240 is secured in the recess 218, the bulkhead assembly 230 is also thereby secured in the housing 210.

As illustrated in FIGS. 15, 16A, 16B and 17, when a plurality/a string of perforating gun modules 200 are connected to each other, the ground bars 90 secured to the positioning devices 110 engage with the inner surface 220 housing 210 to provide a secure and reliable electrical ground contact from the detonator 50' (see FIG. 9), and also contacts the second end portion 214 of the adjacent perforating gun modules 200. The support members 82 of each of the positioning devices 110 of the perforating gun modules 200 may prevent movement of the ground bar 90 along the central Y-axis of the shaped charge holder 20 and help to facilitate the contact of the ground bar with the second end portion of the adjacent perforating gun module 200'.

Figure 15:
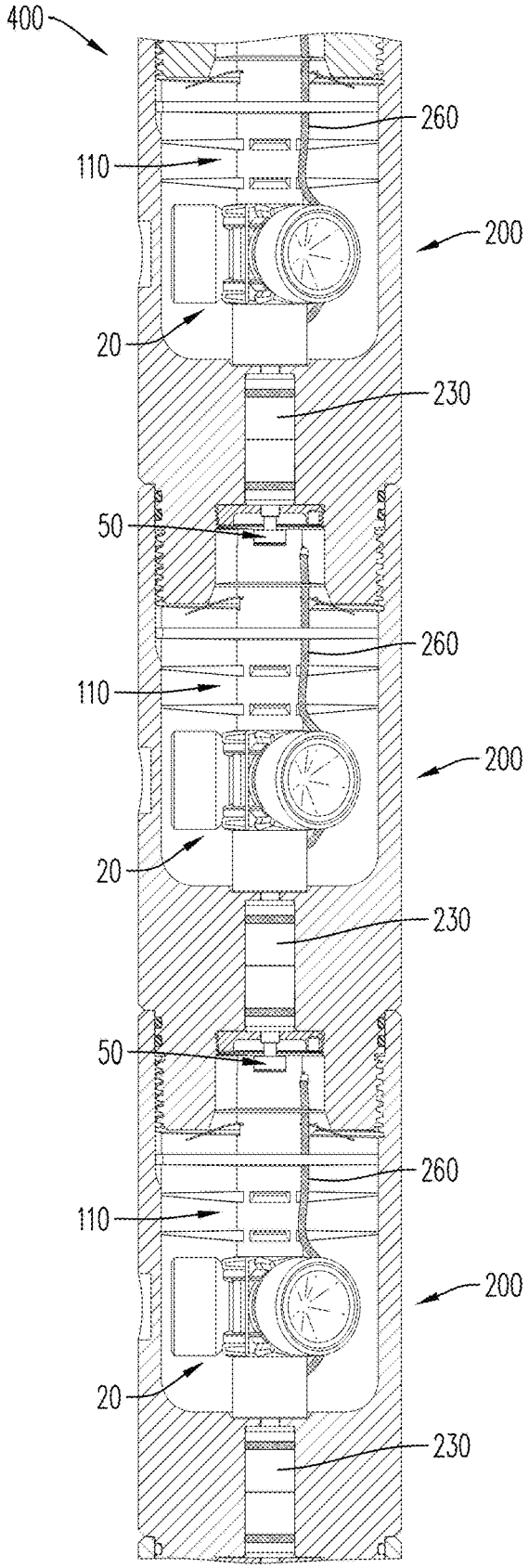
FIG. 15 is a side, partial cross-sectional and perspective view of a string of perforating gun modules, according to an embodiment.
Figure 16A:
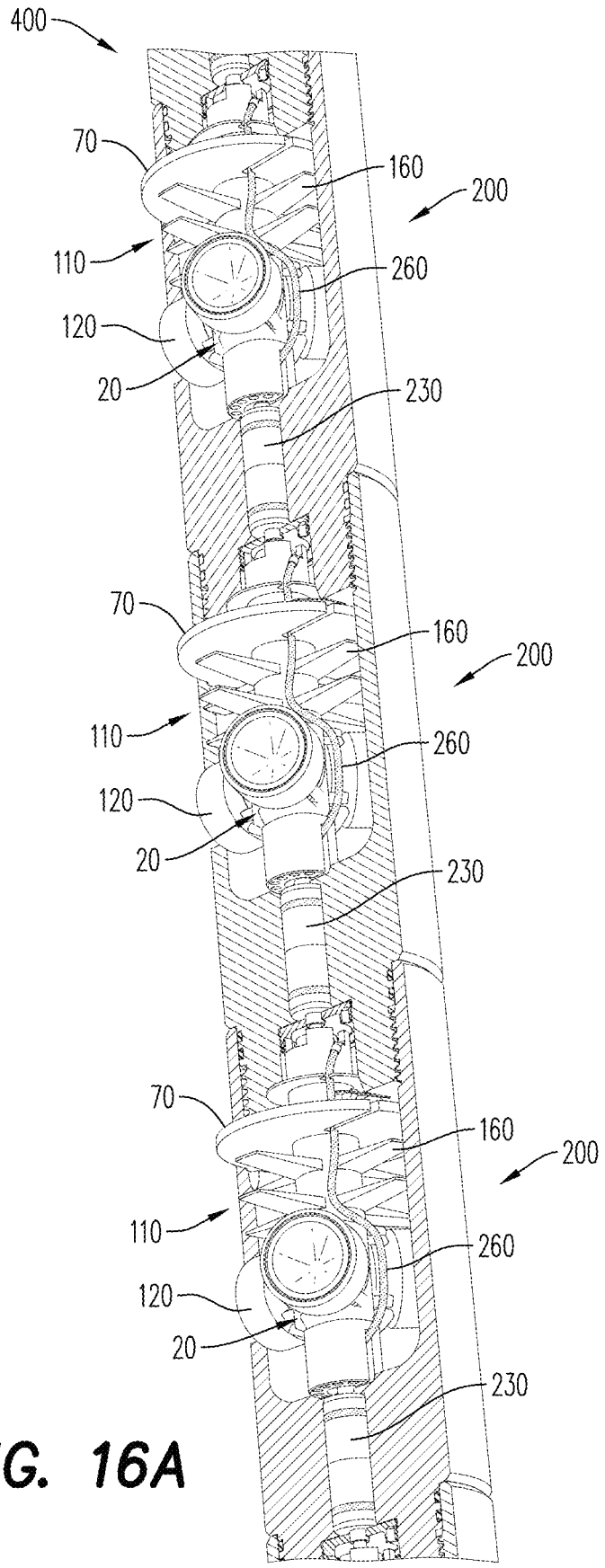
FIG. 16A is a side, partial cross-sectional and perspective view of a string of perforating gun modules configured according to FIG. 10.
Figure 16B:
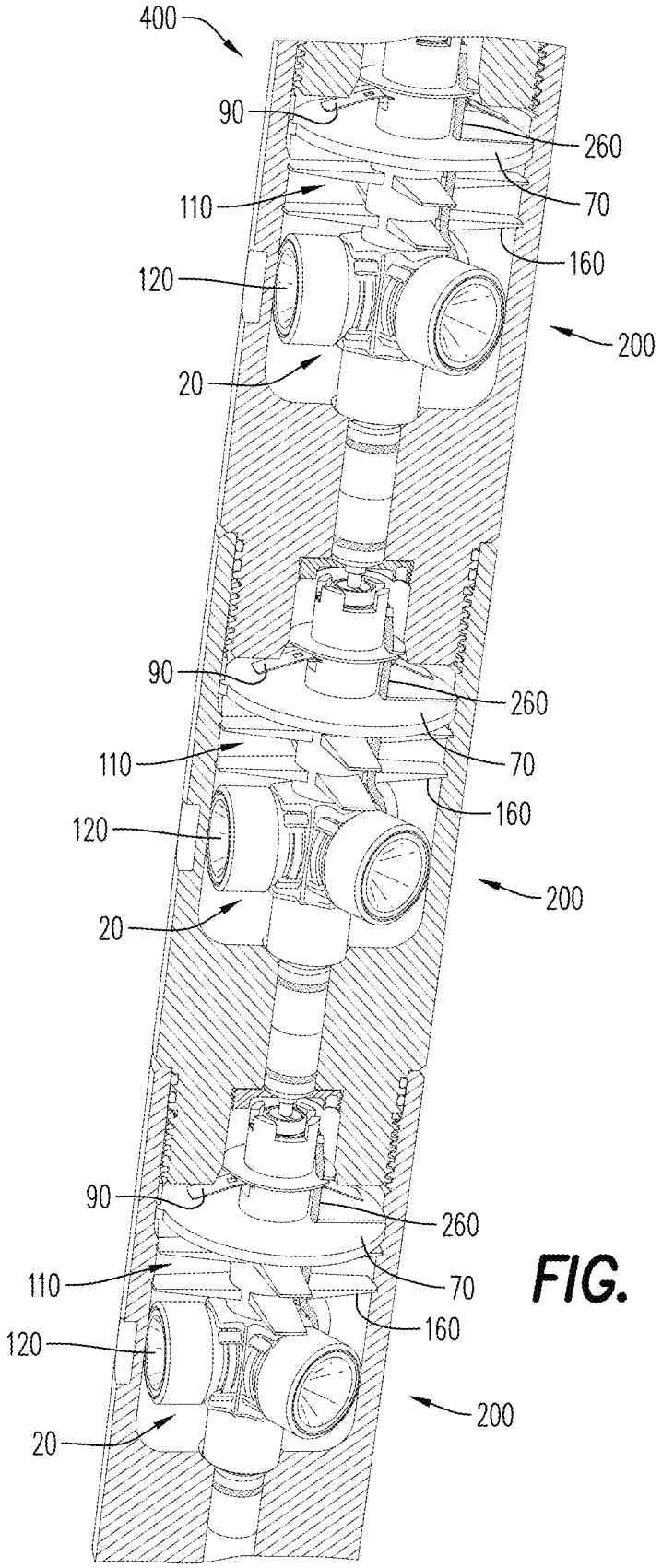
FIG. 16B is a side, partial cross-sectional and perspective view of the string of perforating gun modules of FIG. 16A, illustrating a ground bar positioned in each perforating gun module.

While FIGS. 15, 16A and 16B illustrate the perforating gun modules 200 each including one positioning device 110, it is contemplated that perforating gun modules may be configured to receive more than one positioning device 110, or the positioning device 10 of shaped charge holder 20 described hereinabove with respect to FIGS. 1-2. FIG. 17 illustrates an embodiment in which the positioning device 110 of FIG. 3 is coupled to the positioning device 10 or a separate shaped charge holder 20 of FIGS. 1-2 and are coupled together and secured in a housing 210 of a perforating gun module 200. As described hereinabove with respect to FIG. 11, the elongated cavity 40 of the separate shaped charge holder 20' is retains a detonation extender 55. The detonation extender 55 extends from the elongated opening of the positioning device 110 into the elongated opening of the separate shaped charge holder 20'. The detonation energy from the detonator 50 simultaneously activates the shaped charges 120 of the first set of shaped charges and activates the detonation extender 55, and a detonation wave from the detonation extender 55 simultaneously activates the second set of shaped charges 120' retained in the shaped charge holder 20' or separate positioning device 10.

Embodiments of the disclosure may further be associated with a method of making a perforating gun assembly including a positioning device. The method includes providing a positioning device formed from an injection molded, casted, or 3D printed plastic material or 3-D milled and cut from solid plastic bar stock. The positioning device may be configured substantially as illustrated in FIGS. 1-3. A housing for the perforating gun module is pre-forged from a solid material, such as a block of metal or machinable steel. The block of metal may have a cross-sectional that generally corresponds to the desired cross-sectional shape of the housing. For example, the block of metal may have a cylindrical shape if a cylindrical-shaped housing is desired. According to an aspect, the housing is machined from a solid bar of metal. This requires less metal removal during machining, as compared to typical CNC machining procedures where the body is not pre-forged to a certain shape before machining. This may reduce the time it takes to manufacture the housing and reduces the amount of metal scrap generated during the manufacturing process. The method further includes arranging the positioning device within a chamber of the housing so that the shaped charges are positioned in an XZ-plane, in an outward, radial arrangement, about a central Y-axis of the shaped charge holder.

Embodiments of the disclosure may further be associated with a method of perforating an underground formation in a wellbore using a perforating gun assembly. The method includes selecting/identifying a target shot area for the underground formation. The target shot area may be selected based on a plurality of parameters, such as the desired fluid flow from the formation into the wellbore. The perforating gun assembly includes one or more perforating gun modules including a positioning device having a plurality of shaped charges secured therein. The positioning device is positioned within the chamber of a housing of the module. The positioning device and perforating gun module are configured substantially as described hereinabove with respect to the figures. Thus, for purpose of convenience and not limitation, those features are not repeated here.

The positioning device includes a plurality of shaped charges secured therein. According to an aspect, three shaped charges are positioned in the positioning device. The shaped charges may be arranged in an XZ-plane, in an outward, radial arrangement, about a Y-axis of the shaped charge holder. According to an aspect, the shaped charges are specially designed so that the perforating jets formed upon detonation of the shaped charges has an at least partially altered geometry. At least one of the internal surfaces, the liner geometry and/or liner constituents, and the explosive load of the shaped charges may be modified to change the shape of a perforating jet formed upon detonation of the shaped charges. A detonator is positioned centrally within the shaped charge holder so that it is, or will be, adjacent the initiation points of the shaped charges.

The method further includes positioning the perforating gun assembly in the wellbore adjacent the formation and sending an initiation signal to the detonator. The detonator directly initiates the shaped charges so that they each form a perforating jet. The resulting perforation jets create perforating tunnels in the formation that have the aforementioned altered geometry that facilitates a flow rate or hydraulic fracturing that is equivalent to the flow rate or the hydraulic fracturing typically facilitated by another shaped charge of a different size or composition. The method further includes injecting a fluid into the wellbore to fracture the formation. As described hereinabove, the three shape charges may have a shot performance that is equivalent to that of a traditional shaped charge carrier including 2, 4, 5, 6 or more shaped charges. This may facilitate a cost-effective and efficient way of adjusting the optimal flow path for fluid in the target formation, without modifying the arrangement or quantity of the receptacles of the positioning device.

Examples

Various perforating gun assemblies, including positioning devices and shaped charges, were made and tested, according to the embodiments of the disclosure. The shaped charges where detonated, and the total average shot area entrance hole diameters presented in the examples shown in Table 1 are based on the minimum and maximum hole diameter formed by the perforation jet upon detonation of the shaped charges.

TABLE 1

| Sample | Shaped Charge Diameter/Caliper (inches) | Shot Count/ Quantity of Shaped Charges | Total Average Shot Area of Perforations (square inches ($in^2$)) |
|---|---|---|---|
| A-1 | 0.35 +/− 0.03 | 2 | 0.19 |
| A-2 | 0.30 +/− 0.03 | 3 | 0.21 |
| B-1 | 0.35 +/− 0.03 | 3 | 0.29 |
| B-2 | 0.35 +/− 0.03 | 3 | 0.29 |
| C-1 | 0.35 +/− 0.03 | 4 | 0.38 |
| C-2 | 0.40 +/− 0.04 | 3 | 0.38 |
| D-1 | 0.35 +/− 0.03 | 5 | 0.48 |
| D-2 | 0.45 +/− 0.05 | 3 | 0.48 |
| E-1 | 0.35 +/− 0.03 | 6 | 0.58 |
| E-2 | 0.50 +/− 0.05 | 3 | 0.59 |

The shaped charges tested (the results of the tests being presented in Table 1), each included a substantially cylindrical/conical case, an explosive load contained in a cavity of the case, and a liner disposed adjacent the explosive load. Samples A-1, B-1, C-1, E-1 and D-1 were each 0.35 inch equal entrance hole shaped charges. In Sample A-1, two (2) shaped charges were arranged in a traditional charge carrier. In Sample B-1, three (3) shaped charges were arranged in a traditional charge carrier. Sample C-1, four (4) shaped charges were arranged in a traditional charge carrier. In Sample D-1, five (5) shaped charges were arranged in a traditional charge carrier. In Sample E-1, six (6) shaped charges were arranged in a traditional charge carrier. In each of Samples A-2, B-2, C-2, D-2 and E-2 three (3) shaped charges were arranged in a positioning device configured substantially as described hereinabove. The shaped charges in Sample A-2 were 0.30 inch equal entrance hole shaped charges, the shaped charges in Sample B-2 were 0.35 inch equal entrance hole shaped charges, the shaped charges in Sample C-2 were 0.40 inch equal entrance hole shaped charges, the shaped charges in Sample D-2 were 0.45 inch equal entrance hole shaped charges, and the shaped charges in Sample E-2 were 0.50 inch equal entrance hole shaped charges. Notably, by adjusting only the size of the three (3) shaped charges utilized in Samples A-2, B-2, C-2, D-2 and E-2 and therefore the effective size of the entrance hole generated by the shaped charges in each positioning device, the assembly was able to generate total open areas/open surface areas similar to the total open areas of the traditional charge carriers including 2 shaped charges (Sample A-1), 3 shaped charges (Sample B-1), 4 shaped charges (Sample C-1), 5 shaped charges (Sample D-1) and 6 shaped charges (Sample E-2).

The present disclosure, in various embodiments, configurations and aspects, includes components, methods, processes, systems and/or apparatus substantially developed as depicted and described herein, including various embodiments, sub-combinations, and subsets thereof. Those of skill in the art will understand how to make and use the present disclosure after understanding the present disclosure. The present disclosure, in various embodiments, configurations and aspects, includes providing devices and processes in the absence of items not depicted and/or described herein or in various embodiments, configurations, or aspects hereof, including in the absence of such items as may have been used in previous devices or processes, e.g., for improving performance, achieving ease and/or reducing cost of implementation.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while considering that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that variations in these ranges will suggest themselves to a practitioner having ordinary skill in the art and, where not already dedicated to the public, the appended claims should cover those variations.

The terms "determine", "calculate" and "compute," and variations thereof, as used herein, are used interchangeably and include any type of methodology, process, mathematical operation or technique.

The foregoing discussion of the present disclosure has been presented for purposes of illustration and description. The foregoing is not intended to limit the present disclosure to the form or forms disclosed herein. In the foregoing Detailed Description for example, various features of the present disclosure are grouped together in one or more embodiments, configurations, or aspects for the purpose of streamlining the disclosure. The features of the embodiments, configurations, or aspects of the present disclosure may be combined in alternate embodiments, configurations, or aspects other than those discussed above. This method of disclosure is not to be interpreted as reflecting an intention that the present disclosure requires more features than are expressly recited in each claim. Rather, as the following claims reflect, the claimed features lie in less than all features of a single foregoing disclosed embodiment, configuration, or aspect. Thus, the following claims are hereby incorporated into this Detailed Description, with each claim standing on its own as a separate embodiment of the present disclosure.

Advances in science and technology may make equivalents and substitutions possible that are not now contemplated by reason of the imprecision of language; these variations should be covered by the appended claims. This written description uses examples to disclose the method, machine and computer-readable medium, including the best mode, and also to enable any person of ordinary skill in the art to practice these, including making and using any devices or systems and performing any incorporated methods. The patentable scope thereof is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A holding device comprising:
- a shaped charge holder comprising:
  - a body comprising a plurality of shaped charge receptacles;
  - a plurality of retention mechanisms extending from a portion of the body, wherein each one of the plurality of retention mechanisms is configured to retain a shaped charge within a shaped charge receptacle of the plurality of shaped charge receptacles; and
  - a cavity extending through the body along a central axis of the body, wherein
    - each of the plurality of shaped charge receptacles extends radially from the central axis of the body and the plurality of shaped charge receptacles are arranged in a single axial plane, and
    - each of the plurality of shaped charge receptacles is configured for receiving the shaped charge in a configuration for directly initiating the shaped charge without the use of a detonating cord.

2. The holding device of claim 1, wherein the cavity and each of the plurality of shaped charge receptacles are together configured for exposing an initiation point of the shaped charge adjacent to the cavity.

3. The holding device of claim 1, further comprising a booster positioned at least in part within the cavity, wherein each of the plurality of shaped charge receptacles is configured for receiving the shaped charge in a configuration for directly initiating the shaped charge using the booster.

4. The holding device of claim 3, wherein the booster is initiated by a detonator.

5. The holding device of claim 1, wherein the body is a unitary structure formed from a plastic material.

6. The holding device of claim 1, wherein each of the plurality of shaped charge receptacles is spaced from 60 degrees to 120 degrees around the central axis.

7. The holding device of claim 1, wherein each of the plurality of shaped charge receptacles is configured such that at least a portion of the shaped charge is recessed within the body.

8. The holding device of claim 1, further comprising:
- one or more sets of additional shaped charge receptacles, wherein each set of the additional shaped charge receptacles is arranged an additional axial plane spaced apart from the single axial plane.

9. A holding device comprising:
- a ballistic holder comprising:
  - a channel dimensioned for receiving a detonator; and
- a shaped charge holder connected to the ballistic holder, the shaped charge holder comprising:
  - a body comprising three shaped charge receptacles extending from a central axis of the body, and a plurality of retention mechanisms;
  - a cavity extending through the body along the central axis of the body, wherein
    - each shaped charge receptacle of the three shaped charge receptacles extends radially from the central axis of the body and the three shaped charge receptacles are arranged in a single axial plane, and
    - each retention mechanism of the plurality of retention mechanisms extend from a portion of the body; and
  - a plurality of shaped charges, wherein
    - each shaped charge of the plurality of shaped charges is respectively secured within a corresponding one of the three shaped charge receptacles by one of the plurality of retention mechanisms,
    - the one of the plurality of retention mechanisms is configured to receive the shaped charge secured within the corresponding one of the three shaped charge receptacles and is secured into a groove formed into a wall of the shaped charge,
- wherein each one of the three shaped charge receptacles is configured for receiving and retaining each shaped charge of the plurality of shaped charges in a configuration for directly initiating each shaped charge of the plurality of shaped charges without the use of a detonating cord or a booster device, such that the detonator is in direct ballistic communication with each shaped charge of the plurality of shaped charges.

10. The holding device of claim 9, wherein each of the plurality of shaped charge receptacles comprises a recess formed in the body.

11. The holding device of claim 9, wherein the body is a single unitary structure formed from a plastic material.

12. The holding device of claim 10, wherein the recess and respective retention mechanism of the corresponding one of the three shaped charge receptacles are together configured to guide placement and orientation of the respective shaped charge secured within the corresponding one of the three shaped charge receptacles.

13. The holding device of claim 9, wherein each shaped charge receptacle of the three shaped charge receptacles is configured such that at least a portion of each the shaped charge of the plurality of shaped charges is recessed within the body.

14. A perforating gun assembly comprising:

a perforating gun housing comprising:

a first housing end;

a second housing end; and a chamber extending from the first housing end to the second housing end;

a holding device positioned in the chamber, the holding device comprising:

a ballistic holder including a channel, and a detonator secured in the channel; and a shaped charge holder connected to the ballistic holder, the shaped charge holder comprising:

a body;

a cavity extending through a central axis of the body and in open communication with the channel of the ballistic holder;

a plurality of shaped charge receptacles formed in the body, wherein the plurality of shaped charge receptacles extends radially from the central axis of the body and are arranged in a single axial plane; and a plurality of retention mechanisms extending from a portion of the body adjacent the shaped charge receptacles, wherein the retention mechanisms are biased in a radial direction;

a plurality of shaped charges, wherein each shaped charge of the plurality of shaped charge receptacles is arranged and retained in a respective shaped charge receptacle of the plurality of shaped charge receptacles in the single axial plane and the detonator is in direct ballistic communication with the plurality of shaped charges such that the plurality of shaped charges are detonated without a detonating cord; and an electrical contact secured to the holding device, wherein the perforating gun housing is configured to be connected to an adjacent perforating gun housing without the use of a tandem sub adapter and the chamber of the perforating gun housing is sealed from the adjacent perforating gun housing without the use of the tandem sub adapter.

15. The perforating gun assembly of claim 14, wherein the perforating gun housing comprises a length of 8 inches to 9 inches.

16. The perforating gun assembly of claim 14, wherein the first housing end of the perforating gun housing comprises a plurality of internal threads and the second housing end of the perforating gun housing comprises a plurality of external threads, wherein the plurality of internal threads are configured for connecting to complimentary external threads on the adjacent perforating gun housing, and the plurality of external threads are configured for connecting to complimentary internal threads on the adjacent perforating gun housing, without the use of the tandem sub adapter.

17. The perforating gun assembly of claim 14, wherein the electrical contact comprises:

a ground bar configured to contact a portion of the perforating gun housing or the adjacent perforating gun housing.

18. The perforating gun assembly of claim 14, wherein the detonator initiates a booster positioned adjacent the plurality of shaped charges, and the booster is configured to initiate the plurality of shaped charges.

19. The holding device of claim 18, wherein the channel of the ballistic holder is dimensioned for receiving the detonator, the cavity is dimensioned for receiving the booster, the booster is initiated by the detonator, and the shaped charges are initiated by the booster.

20. The perforating gun assembly of claim 14, further comprising:

one or more sets of additional shaped charge holders comprising additional shaped charge receptacles, wherein each set of the additional shaped charge holders is arranged in a corresponding additional axial plane spaced apart from the single axial plane and other additional axial planes;

a booster in ballistic communication with the detonator; and one or more additional sets of shaped charges, wherein each one of the additional sets of shaped charges is secured in one of the additional shaped charge receptacles, such that the one or more additional sets of shaped charges is in ballistic communication with the booster.

21. The perforating gun assembly of claim 14, wherein the perforating gun housing further comprises:

a slot formed in an inner surface of the perforating gun housing, the slot being configured to receive a protrusion extending from the holding device, to orient the holding device in the chamber of the perforating gun housing.

* * * * *